US008632931B2

(12) United States Patent
Sekido et al.

(10) Patent No.: US 8,632,931 B2
(45) **Date of Patent: *Jan. 21, 2014**

(54) ELECTROPHOTOGRAPHIC PHOTOSENSITIVE MEMBER, PROCESS CARTRIDGE, AND ELECTROPHOTOGRAPHIC APPARATUS

(75) Inventors: Kunihiko Sekido, Numazu (JP); Hideaki Nagasaka, Suntou-gun (JP); Michiyo Sekiya, Mishima (JP); Shinji Takagi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 487 days.

This patent is subject to a terminal disclaimer.

(21) Appl. No.: 12/625,801

(22) Filed: Nov. 25, 2009

(65) Prior Publication Data

US 2011/0143273 A1 Jun. 16, 2011

(30) Foreign Application Priority Data

Nov. 2, 2009 (JP) ..... 2009-252076

(51) Int. Cl.
*G03G 5/14* (2006.01)

(52) U.S. Cl.
USPC ..... 430/60; 430/62; 430/64; 399/159

(58) Field of Classification Search
USPC ..... 430/64, 60, 62; 399/159
See application file for complete search history.

(56) References Cited

U.S. PATENT DOCUMENTS

| | | | | | |
|---|---|---|---|---|---|
| 4,082,551 | A | * | 4/1978 | Steklenski et al. | 430/64 |
| 4,418,117 | A | * | 11/1983 | Shaw | 430/62 |
| 4,442,193 | A | | 4/1984 | Chen et al. | 430/83 |
| 4,508,804 | A | * | 4/1985 | Asao et al. | 430/62 |
| 4,562,132 | A | | 12/1985 | Ong et al. | 430/59 |
| 4,599,288 | A | * | 7/1986 | Fuchizawa | 430/63 |
| 4,933,246 | A | | 6/1990 | Teuscher | |
| 4,992,349 | A | | 2/1991 | Chen et al. | 430/58 |
| 4,994,339 | A | | 2/1991 | Kinoshita et al. | |
| 5,110,700 | A | * | 5/1992 | Teuscher et al. | 430/64 |
| 5,401,600 | A | * | 3/1995 | Aizawa et al. | 430/65 |
| 5,468,583 | A | | 11/1995 | Gruenbaum et al. | 430/58 |
| 5,508,137 | A | | 4/1996 | Langhals | 430/78 |
| 5,604,061 | A | | 2/1997 | Sekido et al. | 430/58 |
| 5,641,599 | A | * | 6/1997 | Markovics et al. | 430/64 |
| 5,658,702 | A | | 8/1997 | Nukada | 430/58 |
| 5,667,097 | A | | 9/1997 | Joyce | |
| 5,677,097 | A | | 10/1997 | Nukada et al. | |
| 5,795,690 | A | | 8/1998 | Takegawa et al. | 430/58 |
| 5,815,776 | A | | 9/1998 | Nukada | 399/174 |
| 6,750,288 | B2 | | 6/2004 | Pradel | 525/100 |
| 6,831,131 | B2 | | 12/2004 | Bouilloux et al. | 525/191 |
| 8,343,699 | B2 | * | 1/2013 | Nagasaka et al. | 430/60 |
| 2002/0182524 | A1 | | 12/2002 | Uchida et al. | |
| 2003/0040579 | A1 | | 2/2003 | Pradel | 525/191 |
| 2003/0130429 | A1 | | 7/2003 | Bouilloux et al. | 525/240 |
| 2003/0187128 | A1 | | 10/2003 | Shiba et al. | 524/556 |
| 2007/0178396 | A1 | * | 8/2007 | Wu et al. | 430/69 |

FOREIGN PATENT DOCUMENTS

| | | | | |
|---|---|---|---|---|
| EP | 0 715 217 | A2 | | 6/1996 |
| JP | 01-206349 | | | 8/1989 |
| JP | 01289966 | A | * | 11/1989 |
| JP | 2-183265 | A | | 7/1990 |
| JP | 05-279582 | | | 10/1993 |
| JP | 07-070038 | | | 3/1995 |
| JP | 07-089962 | | | 4/1995 |
| JP | 8-146639 | A | | 6/1996 |
| JP | 09-015889 | | | 1/1997 |
| JP | 09-127716 | | | 6/1997 |
| JP | 09-197702 | | | 7/1997 |
| JP | 09-258468 | | | 10/1997 |
| JP | 09258468 | A | * | 10/1997 |
| JP | 2002-341570 | A | | 11/2002 |
| JP | 2003-29440 | A | | 1/2003 |
| JP | 2003-105145 | | | 4/2003 |
| JP | 2003-119328 | | | 4/2003 |
| JP | 2003-147028 | | | 5/2003 |
| JP | 2003-255576 | A | | 9/2003 |
| JP | 2003-268164 | | | 9/2003 |
| JP | 2004-093791 | | | 3/2004 |
| JP | 2007148294 | A | * | 6/2007 |
| JP | 2008-184386 | A | | 8/2008 |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

English language machine translation of JP 09-258468 (Oct. 1997).*

English language machine translation of JP 2007-148294 (Jun. 2007).*

English translation of Chinese Office Action dated Jan. 18, 2012 in Chinese Application No. 200910178400.0.

Search Report dated Feb. 3, 2011 in European Application No. 09177199.8.

Chinese Office Action dated Jul. 20, 2012 in Chinese Application No. 200910178400.0.

Hideki Okada et al., "Synthesis and Properties of a Novel Electron Transporting Compound, 3,3'-dialkyl-4,4'-bisnaphthylquinone (DBNQ)" Pan-Pacific Imaging Conference/Japan Hardcopy '98, Jul. 15-17, 1998.

Masaki Yamada et al., "Synthesis and Properties of Diamino-Substituted Dipyrido [3,2-*a*: 2'3'-*c*]phenazine" Bull. Chem. Soc. Jpn., vol. 65, pp. 1006-1011, (1992).

Ronald Callahan et al., "Syntheses of Phencyclone Analogues. Applications for NMR Studies of Hindered Rotations and Magnectic Anisotropy in Crowded Diels-Alder Adducts," Chem. Educator, vol. 6, pp. 227-234, (2001).

Shinji Aramaki, "Application of Azo Pigments to Electrophotgraphy" The Journal of Imaging Society of Japan, vol. 37, Part 3, pp. 280-286, Jul. 23, 1998.

* cited by examiner

*Primary Examiner* — Christopher Rodee

(74) *Attorney, Agent, or Firm* — Fitzpatrick, Cella, Harper & Scinto

(57) ABSTRACT

The present invention relates to an electrophotographic photosensitive member obtained by providing an intermediate layer and a photosensitive layer on a conductive support in the stated order, the electrophotographic photosensitive member being characterized in that the intermediate layer contains a specific polyolefin resin and a specific organic electron-transporting substance, and a process cartridge and an electrophotographic apparatus each having the electrophotographic photosensitive member.

5 Claims, 3 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, a process cartridge, and an electrophotographic apparatus.

2. Description of the Related Art

Electrophotography has recently shown significant development, so extremely sophisticated characteristics have been requested of electrophotographic photosensitive members. For example, the process speeds of the electrophotographic photosensitive members are increasing year after year, so demands for the potential characteristics of the electrophotographic photosensitive members have become more and more stringent. In addition, an improvement in image quality typified by colorization has been requested of each of the electrophotographic photosensitive members in recent years; with the advent of the representation with colors, the number of halftone images and solid images typified by photographs has been increasing, and the quality of any such image is improving year after year without cessation. For example, an allowable range for the following phenomenon, i.e., the so-called positive ghost image has become markedly limited as compared to that in the case of a monochromatic printer or monochromatic copying machine: when a portion irradiated with light in one image is turned into a halftone image in a subsequent rotation of any one of the electrophotographic photosensitive members, the density of only the portion irradiated with light increases.

The constitutions of the electrophotographic photosensitive members are classified into: a constitution in which a laminate type photosensitive layer formed of a charge generation layer containing a charge-generating substance such as an azo pigment or a phthalocyanine pigment and a hole transport layer containing a hole-transporting substance such as a hydrazone compound, a triarylamine compound, or a stilbene compound is provided on a conductive support; and a constitution in which a single-layer type photosensitive layer containing both the charge-generating substance and the hole-transporting substance is provided on the conductive support. However, merely providing any such photosensitive layer on the conductive support is often responsible for such problems as described below: the photosensitive layer peels, or defects (including form defects such as flaws and material defects such as impurities) in the surface of the conductive support are directly reflected in an image formed with any one of the electrophotographic photosensitive members, so black-dot image defects or blank dots occur. A layer called an intermediate layer has been provided between the photosensitive layer and conductive support of each of many electrophotographic photosensitive members to compensate for such problems. However, some of the electrophotographic photosensitive members show deterioration of their characteristics probably due to the intermediate layer, so attempts have been made to improve the characteristics of the intermediate layer with various approaches (Japanese Patent Application Laid-open No. Hei 9-015889, Japanese Patent Application Laid-open No. Hei 9-258468, Japanese Patent Application Laid-open No. Hei 9-197702, and Japanese Patent Application Laid-open No. Hei 9-127716). Of the approaches, the use of a thermosetting resin or polyvinyl butyral as a resin for the intermediate layer has been adopted, but the approach has not arrived at a level enough to satisfy the recent stringent request for the characteristics.

Meanwhile, for example, a polyolefin resin has been known to serve as a resin excellent in dielectric characteristic, but no proposals have been made on the use of the resin in an intermediate layer for an electrophotographic photosensitive member, the intermediate layer satisfying all required characteristics such as a coating characteristic, solvent resistance, and an electrophotographic characteristic.

SUMMARY OF THE INVENTION

The present invention provides an electrophotographic photosensitive member which: can form good output images in which the number of positive ghost images is reduced; and has good photosensitivity. Another object of the present invention is to provide a process cartridge and an electrophotographic apparatus each having the electrophotographic photosensitive member.

The inventors of the present invention have found that an electrophotographic photosensitive member having an intermediate layer containing the following substances is an electrophotographic photosensitive member capable of achieving a high level of compatibility between an improvement in its photosensitivity and the alleviation of a positive ghost: a polyolefin resin containing an ethylene unit having at least one of a carboxylic acid group and a carboxylic anhydride group as a repeating structural unit, and an organic electron-transporting substance.

The inventors of the present invention predict that the reason why the electrophotographic photosensitive member having the intermediate layer containing the polyolefin resin containing the ethylene unit having at least one of a carboxylic acid group and a carboxylic anhydride group as a repeating structural unit, and the organic electron-transporting substance has such excellent characteristics is attributable to the following effect: because a high level of compatibility between an improvement in the photosensitivity and the alleviation of a positive ghost can be achieved when both the resin and the substance are combined, the carboxylic acid group or carboxylic anhydride group having a moderate electron-withdrawing characteristic promotes the injection of electrons from the charge-generating substance in the charge generation layer to the organic electron-transporting substance in the intermediate layer, and hence, the molecular chain of the polyolefin resin having lowly biased electron clouds is present near the organic electron-transporting substance, so a smooth electron hopping transfer between the molecules of the organic electron-transporting substance is promoted.

That is, the present invention provides an electrophotographic photosensitive member, including: a conductive support; an intermediate layer; and a photosensitive layer, the intermediate layer and the photosensitive layer being provided on the conductive support in the stated order, in which: the intermediate layer contains a polyolefin resin and an organic electron-transporting substance; the polyolefin resin includes a polyolefin resin containing the following repeating structural units (A1) and (A2); and the organic electron-transporting substance includes a compound selected from the group consisting of an imide-based compound, a benzimidazole-based compound, a quinone-based compound, a cyclopentadienylidene-based compound, an azo-based compound, and derivatives of the compounds:

(A1): a repeating structural unit represented by the following formula (11)

(11)

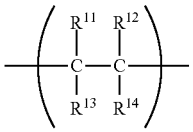

where $R^{11}$ to $R^{14}$ each independently represent a hydrogen atom or an alkyl group;

(A2): a repeating structural unit represented by one of the following formulae (21) or (22)

(21)

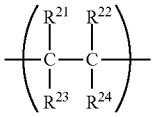

(22)

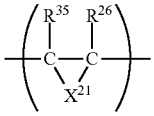

where $R^{21}$ to $R^{24}$ each independently represent a hydrogen atom, an alkyl group, a phenyl group, or a monovalent group represented by —$Y^{21}$COOH where $Y^{21}$ represents a single bond, an alkylene group, or an arylene group, $R^{25}$ and $R^{26}$ each independently represent a hydrogen atom, an alkyl group, or a phenyl group, and $X^{21}$ represents a divalent group represented by —$Y^{22}$COOCO$Y^{23}$— where $Y^{22}$ and $Y^{23}$ each independently represent a single bond, an alkylene group, or an arylene group, provided that at least one of $R^{21}$ to $R^{24}$ represents a monovalent group represented by —$Y^{21}$COOH.

According to the present invention, there can be provided an electrophotographic photosensitive member which: can form good output images in which the number of positive ghost images is reduced; and has good photosensitivity. In addition, according to the present invention, there can be provided a process cartridge and an electrophotographic apparatus each having the above electrophotographic photosensitive member.

Further features of the present invention will become apparent from following description of exemplary embodiments with reference to the attached drawings.

DESCRIPTION OF THE EMBODIMENTS

Figure 1:
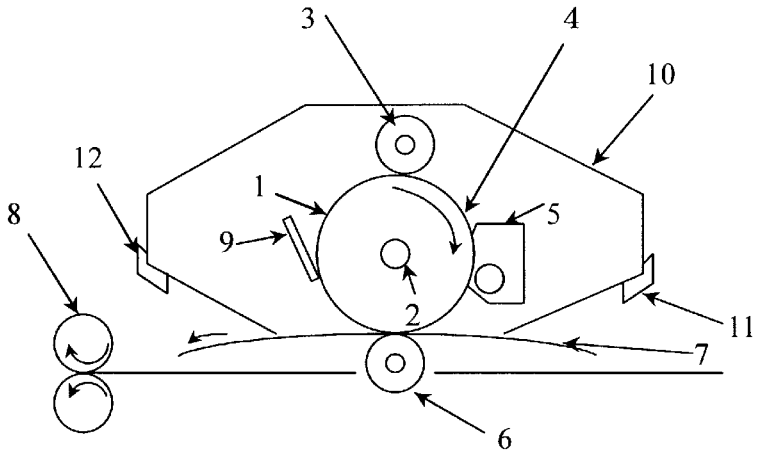
FIG. 1 is a view illustrating an example of the outline constitution of an electrophotographic apparatus including a process cartridge having an electrophotographic photosensitive member of the present invention.

Hereinafter, an electrophotographic photosensitive member of the present invention is described in detail.

The electrophotographic photosensitive member of the present invention is an electrophotographic photosensitive member obtained by providing, on a conductive support, an intermediate layer and a photosensitive layer in the stated order. In addition, the intermediate layer contains a polyolefin resin and an organic electron-transporting substance.

Examples of the conductive support used in the present invention include: metals such as aluminum, nickel, copper, gold, and iron, and alloys of the metals; conductive supports each obtained by forming a thin film formed of a metal such as aluminum, silver, or gold or of a conductive material such as indium oxide or tin oxide on an insulating support formed of, for example, polyester, polycarbonate, polyimide, or glass.

The surface of such conductive support may be subjected to an electrochemical treatment such as anodization or to a treatment such as wet horning, blasting, or cutting in order that the electrical characteristics of the conductive support may be improved, or interference fringes that are of concern when the electrophotographic photosensitive member is irradiated with coherent light such as semiconductor laser may be prevented.

The intermediate layer and the photosensitive layer are formed on the conductive support of the electrophotographic photosensitive member of the present invention in the stated order.

Known examples of the photosensitive layer include a single-layer type and a laminate type. The laminate type photosensitive layer preferably includes at least a charge generation layer and a hole transport layer.

The charge generation layer is preferably formed by incorporating a charge-generating substance, a binder resin, and any other component. The charge generation layer can be formed by, for example, a method involving: dissolving the binder resin in a solvent; adding and dispersing the charge-generating substance to and in the solution; applying the resultant application liquid for a charge generation layer; and drying the applied liquid. A media type dispersing machine such as a sand mill or ball mill, or a liquid-collision type dispersing machine can be used upon dispersion of the charge-generating substance.

Examples of the charge-generating substance include the following: azo-based pigments such as a monoazo pigment, a bisazo pigment, and a trisazo pigment; perylene-based pigments such as perylene acid anhydrides and perylene acid imides; anthraquinone-based or polycyclic quinone-based pigments such as an anthraquinone derivative, an anthoanthrone derivative, a dibenzpyrenequinone derivative, a pyranthrone derivative, a violanthrone derivative, and an isoviolanthrone derivative; indigoid-based pigments such as an inidigo derivative and a thioindigo derivative; phthalocyanine-based pigments such as metallic phthalocyanine and non-metallic phthalocyanine; and perinone-based pigments such as a bisbenzimidazole derivative. Of those, azo-based pigments and phthalocyanine-based pigments are preferable. Of those, oxytitanium phthalocyanine, chlorogallium phthalocyanine, and hydroxygallium phthalocyanine are preferable.

As the oxytitanium phthalocyanine, in the X-ray diffraction spectrum having CuKα as a radiation source, an oxytitanium phthalocyanine crystal having strong peaks at Bragg angles (2θ±0.2°) of 9.0°, 14.2°, 23.9°, and 27.1° and an oxytitanium phthalocyanine crystal having strong peaks at Bragg angles (2θ±0.2°) of 9.5°, 9.7°, 11.7°, 15.0°, 23.5°, 24.1°, and 27.3° is preferable.

As the chlorogallium phthalocyanine, in the X-ray diffraction spectrum having CuKα as a radiation source, a chlorogallium phthalocyanine crystal having strong diffraction peaks at Bragg angles (2θ±0.2°) of 7.4°, 16.6°, 25.5°, and 28.2°, a chlorogallium phthalocyanine crystal having strong diffraction peaks at Bragg angles (2θ±0.2°) of 6.8°, 17.3°, 23.6°, and 26.9°, and a chlorogallium phthalocyanine crystal having strong diffraction peaks at Bragg angles (2θ±0.2°) of 8.7°, 9.2°, 17.6°, 24.0°, 27.4°, and 28.8° is preferable.

As the hydroxygallium phthalocyanine, in the X-ray diffraction spectrum having CuKα as a radiation source, a hydroxygallium phthalocyanine crystal having strong diffraction peaks at Bragg angles (2θ±0.2°) of 7.3°, 24.9°, and 28.1° and a hydroxygallium phthalocyanine crystal having strong diffraction peaks at Bragg angles (2θ±0.2°) of 7.5°, 9.9°, 12.5°, 16.3°, 18.6°, 25.1°, and 28.3° is preferable.

Further, in the present invention, the Bragg angle in the CuKα characteristic X-ray diffraction of the crystal of a phthalocyanine in a crystal form was measured under the following condition:

Measuring apparatus: Fully-automatic X-ray diffraction apparatus (trade name: "MXP18", manufactured by MAC Science K.K.)
X-ray tube: Cu
Tube voltage: 50 kV
Tube current: 300 mA
Scanning method: 2θ/θ scan
Scanning speed: 2 deg./min
Sampling interval: 0.020 deg.
Starting angle (2θ): 5 deg.
Stopping angle (2θ): 40 deg.
Divergence slit: 0.5 deg.
Scattering slit: 0.5 deg.
Receiving slit: 0.3 deg.
Curved monochromator used.

Examples of the binder resin used in the charge generation layer include polymers and copolymers formed of vinyl compounds such as styrene, vinyl acetate, vinyl chloride, acrylate, methacrylate, vinylidene fluoride, and trifluoroethylene; polyvinyl alcohol; polyvinyl acetal; polycarbonate; polyester; polysulfone; polyphenylene oxide; polyurethane; cellulose resins; phenol resins; melamine resins; silicon resins; and epoxy resins. Of those, polyester, polycarbonate, and polyvinyl acetal are preferable. Of those, polyvinyl acetal is more preferable.

A ratio between the charge-generating substance and the binder resin (charge-generating substance/binder resin) is preferably 10/1 to 1/2, or more preferably 7/2 to 1/1 in terms of a mass ratio.

The hole transport layer preferably contains a hole-transporting substance and a binder resin the molecules of which are in dispersed states. The hole transport layer can be formed by: dissolving the binder resin having film formability and the hole-transporting substance in a solvent; applying the resultant application liquid for a hole transport layer; and drying the applied liquid.

Examples of the hole transporting substance include, polycyclic aromatic compounds, heterocyclic compounds, hydrazone-based compounds, styryl-based compounds, benzidine-based compounds, triarylamine-based compounds, triphenylamine-based compounds, and a polymer having a group formed of each of those compounds in a main chain or a side chain.

Examples of the binder resin used in the hole transport layer include polyester, polycarbonate, polymethacrylate, polyarylate, polysulfone, and polystyrene. Of those, polycarbonate and polyarylate are particularly preferable. In addition, the molecular weight measured by gel permeation chromatography (GPC) is preferably 10,000 to 300,000 in terms of weight average molecular weight (Mw).

A ratio between the hole-transporting substance and the binder resin (hole-transporting substance/binder resin) is preferably 10/5 to 5/10, or more preferably 10/8 to 6/10 in terms of a mass ratio.

A surface protective layer may be formed on the hole transport layer. The surface protective layer preferably contains a binder resin, and conductive particles and/or a hole-transporting substance. In addition, the layer may contain an additive such as a lubricant. Alternatively, the binder resin itself may have conductivity or a hole-transporting characteristic; in this case, there is no need to incorporate the conductive particles or the hole-transporting substance in addition to the binder resin. The binder resin may be a curable resin that cures with heat, light, or radiation, or may be a non-curable, thermoplastic resin.

In the electrophotographic photosensitive member of the present invention, the intermediate layer containing the polyolefin resin and the organic electron-transporting substance is formed between the photosensitive layer and the conductive support described above.

The intermediate layer may be formed only of one layer, or may be formed of multiple layers. When the intermediate layer is formed of multiple layers, at least one of the layers contains the polyolefin resin and the organic electron-transporting substance.

The mass ratio (%) of the above polyolefin resin in the intermediate layer is preferably 20% to 60%. In addition, the mass ratio (%) of the above organic electron-transporting substance in the intermediate layer is preferably 40% to 80%.

The polyolefin resin used in the present invention is a polyolefin resin containing the following repeating structural units (A1) and (A2):

(A1): a repeating structural unit represented by the following formula (11)

(11)

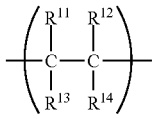

where $R^{11}$ to $R^{14}$ each independently represent a hydrogen atom or an alkyl group;

(A2): a repeating structural unit represented by one of the following formulae (21) or (22)

(21)

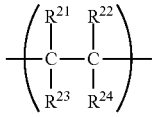

(22)

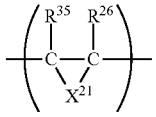

where $R^{21}$ to $R^{24}$ each independently represent a hydrogen atom, an alkyl group, a phenyl group, or a monovalent group represented by $—Y^{21}COOH$ where $Y^{21}$ represents a single bond, an alkylene group, or an arylene group, $R^{25}$ and $R^{26}$ each independently represent a hydrogen atom, an alkyl group, or a phenyl group, and $X^{21}$ represents a divalent group represented by —$Y^{22}COOCOY^{23}$— where $Y^{22}$ and $Y^{23}$ each independently represent a single bond, an alkylene group, or an arylene group, provided that at least one of $R^{21}$ to $R^{24}$ represents a monovalent group represented by —$Y^{21}COOH$; and $R^{11}$ to $R^{14}$ in the formula (11) for the above units (A1) each represent preferably a hydrogen atom, a methyl group, an ethyl group, a propyl group, a butyl group, a pentyl group, or a hexyl group, or more preferably a hydrogen atom, a methyl group, or an ethyl group. In addition, the units (A1) each preferably have 2 to 4 carbon atoms.

The units (A1) are each obtained by a polymerization reaction in the presence of a monomer having a carbon-carbon double bond, and preferable examples of the monomer for constituting any one of the units (A1) include alkenes each having 2 to 4 carbon atoms such as ethylene, propylene, isobutylene, and 1-butene. A mixture of two or more of such alkenes can also be used.

The mass ratio (%) of the repeating structural units each represented by the formula (A1) is preferably 68 mass % or more, more preferably 68 mass % or more and 96 mass % or less, or still more preferably 75 mass % or more and 94 mass % or less of the polyolefin resin.

In a monovalent group represented by —$Y^{21}COOH$, which at least one of $R^{21}$ to $R^{24}$ in the formula (21) of the units (A2) described above represents, $Y^{21}$ preferably represents a single bond, a methylene group, or an arylene group, and more preferably a single bond. Preferable other substituents of $R^{21}$ to $R^{24}$ include a hydrogen atom, a methyl group, an ethyl group, and a propyl group, of which a hydrogen atom and a methyl group are more preferable.

Examples of preferable substituents of $R^{25}$ and $R^{26}$ in the formula (22) include a hydrogen atom and a methyl group, of which a hydrogen atom is more preferable. $Y^{22}$ and $Y^{23}$ of an acid anhydride group —$Y^{22}COOCOY^{23}$— represented by $X^{21}$ is preferably a single bond or a methylene group, and more preferably a single bond.

The units (A2) described above may be introduced by a polymerization reaction in the presence of a monomer having a carbon-carbon double bond and at least one of a carboxylic acid group and a carboxylic anhydride group. Examples of the monomer which may be used for forming the units (A2) include acrylic acid, methacrylic acid, maleic acid, maleic anhydride, citraconic acid, citraconic anhydride, itaconic acid, itaconic anhydride, fumaric acid, crotonic acid, cinnamic acid, hexenoic acid, and octanoic acid; half esters and half amides of unsaturated dicarboxylic acids; and mixtures thereof. Of those, maleic anhydride is particularly preferable.

The mass ratio (%) of the units (A2) in the polyolefin resin is preferably 20 mass % or less, or more preferably 2 mass % or more and 6 mass % or less.

Although the molecular weight of the polyolefin resin used in the present invention is not particularly limited, a resin having a molecular weight of 10,000 to 50,000 is preferably used. A method of synthesizing the resin is not particularly limited either. The above polyolefin resin can be obtained by, for example, the polymerization of a monomer having a carbon-carbon double bond or the graft polymerization of a polyolefin resin and the monomer having a carbon-carbon double bond. An available method for the polymerization in this case is, for example, radical polymerization, cation polymerization, anion polymerization, or coordination polymerization; to be specific, the resin can be synthesized by any one of the known methods described in, for example, the chapters 1 to 4 of "New Polymer Experiment 2 Synthesis and Reaction of Polymer (1)" (Kyoritsu Shuppan Co., Ltd.), Japanese Patent Application Laid-open No. 2003-105145, and Japanese Patent Application Laid-open No. 2003-147028.

The above polyolefin resin may be a copolymer further containing components (repeating structural units) except the above units (A1) and (A2) as its repeating structural units.

The repeating structural units except the above units (A1) and (A2), which are not particularly limited, are preferably repeating structural units each represented by the following formula (31), (32), (33), or (34).

(31)

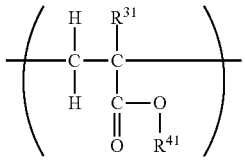

(32)

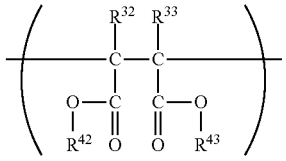

(33)

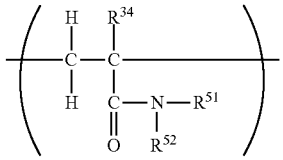

(34)

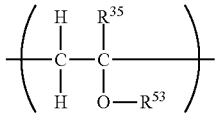

In the formulae (31) to (34), $R^{31}$ to $R^{35}$ each independently represent a hydrogen atom or a methyl group, $R^{41}$ to $R^{43}$ each independently represent an alkyl group having 1 to 10 carbon atoms, and $R^{51}$ to $R^{53}$ each independently represent a hydrogen atom or an alkyl group having 1 to 10 carbon atoms.

Of those, the formula (31) is particularly preferable, and further, $R^{31}$ preferably represents a hydrogen atom or a methyl group, and $R^{41}$ preferably represents a methyl group, an ethyl group, or a propyl group.

Those repeating structural units are obtained by a polymerization reaction in the presence of an arbitrary monomer having a carbon-carbon double bond. Examples of the monomer component include acrylate esters such as methyl acrylate, ethyl acrylate, butyl acrylate, methyl methacrylate, ethyl methacrylate, and butyl methacrylate; maleate esters such as dimethyl maleate, diethyl maleate, and dibutyl maleate; amide acrylates; alkylvinyl ethers such as methyl vinyl ether and ethyl vinyl ether; vinyl esters such as vinyl formate, vinyl acetate, vinyl propionate, vinyl pivalate, vinyl versatate; and vinyl alcohols obtained by saponifying vinyl esters by basic compounds; other dienes; acrylonitrile; halogenated vinyls; halogenated vinylidenes; and mixtures thereof. Of those, acrylate esters and methacrylate esters are more preferable.

The content of the repeating structural units except the above units (A1) and (A2) in the polyolefin resin, which is not limited as long as an effect of the present invention is exerted, is preferably 5 to 30 mass %.

The repeating structural units (A1) and (A2), and the repeating structural units except them have only to be copolymerized, and a mode for the polymerization is not limited; for example, random copolymerization, block copolymerization, or graft copolymerization is permitted.

In the present invention, the characteristics of the resin were measured or evaluated by the following methods.

(1) Content of Units (A2)

The acid value of the polyolefin resin was measured in conformity with JIS K5407, and the content (graft ratio) of the units (A2) was determined from the value with the following equation.

$$\text{Content (mass \%) of units } (A2) = (\text{mass of units } (A2)) / (\text{mass of raw material polyolefin resin}) \times 100$$

(2) Constitution of Resin Except Units (A2)

The content of a unit except the units (A2) was determined by performing $^{1}$H-NMR and $^{13}$C-NMR analysis with an analyzer (manufactured by Varian Technologies Japan Limited, 300 MHz) in o-dichlorobenzene (d4) at 120° C. The $^{13}$C-NMR analysis was performed by employing a gated decoupling method taking quantitativeness into consideration.

In the present invention, the organic electron-transporting substance incorporated into the intermediate layer is an organic compound having an ability to transport (convey) an electron. In the present invention, the term "organic electron-transporting substance" refers to a substance having an ability to convey an electron generated in the charge generation layer to the side of the conductive support. The organic electron-transporting substance is also called an organic electron-conveying substance. Specifically, imide-based compounds such as perylene imide, perylene red 189, perylene red 178, and naphthyl imide; benzimidazole-based compounds such as perynone orange and perynone red 194; quinone-based compounds such as benzoquinone, diphenoquinone, diiminoquinone, naphthoquinone, stilbenequinone, anthraquinone, phenanthrenequinone, and phenanthrolinequinone; cyclopentadienylene-based compounds such as fluorenylidene aniline, fluorenylidene malononitrile, and fluorenon; azo-based compounds such as monoazo compounds, diazo compounds, and trisazo compounds; and derivatives thereof.

Specific structure examples (1) to (9) as examples of the compounds each of which qualifies as the organic electron-transporting substance are shown below. Those structures are preferable, or products obtained by polymerizing those structures are preferable.

The imide-based compound is, for example, a compound having a cyclic imide structure, and aromatic rings may be fused in the compound. Specific examples of the compound include compounds each represented by the following formula (1).

(1)

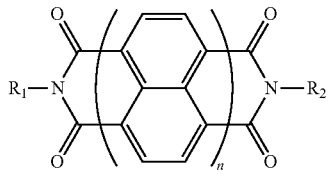

In the formula (1), $R_1$ and $R_2$ each independently represent a substituted or unsubstituted alkyl group, or a substituted or unsubstituted aryl group, examples of the substituent which the alkyl group may have include a hydroxyl group, a carboxyl group, and an alkoxy group, examples of the substituent which the aryl group may have include an alkyl group, a nitro group, a cyano group, a carboxyl group, a halogen group, a haloalkyl group, a phenyldiazenyl group, a hydroxyl group, and a hydroxyalkyl group, and n represents 1 or 2.

The benzimidazole-based compound is, for example, a compound having a benzimidazole ring structure, and aromatic rings may be fused in the compound. Specific examples of the compound include compounds each represented by any one of the following formulae (2) to (4).

(2)

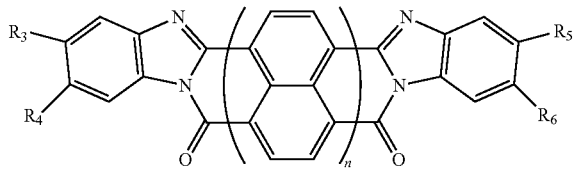

In the formula (2), $R_3$ to $R_6$ each independently represent a hydrogen atom, a substituted or unsubstituted alkyl group, or a halogen group, n represents 1 or 2, and examples of the substituent which the alkyl group may have include a hydroxyl group and a carboxyl group.

(3)

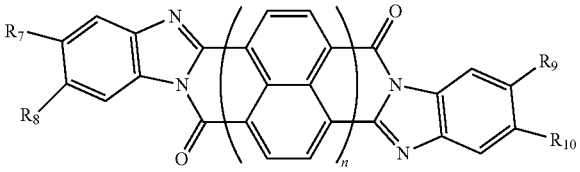

In the formula (3), $R_7$ to $R_{10}$ each independently represent a hydrogen atom, a substituted or unsubstituted alkyl group, or a halogen group, n represents 1 or 2, and examples of the substituent which the alkyl group may have include a hydroxyl group and a carboxyl group.

(4)

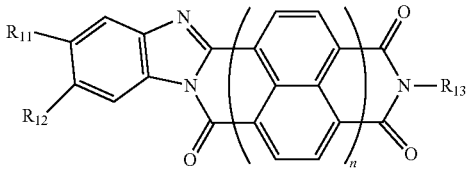

In the formula (4), $R_{11}$ and $R_{12}$ each independently represent a hydrogen atom, a substituted or unsubstituted alkyl group, a halogen group, or a nitro group, $R_{13}$ represents a substituted or unsubstituted alkyl group, or a substituted or unsubstituted aryl group, examples of the substituent which the alkyl group may have include a hydroxyl group and a carboxyl group, examples of the substituent which the aryl group may have include an alkyl group, a nitro group, a cyano group, a carboxyl group, a halogen group, and a haloalkyl group, and n represents 1 or 2.

The quinone-based compound is, for example, a compound having a p-quinoid structure or o-quinoid structure, and aromatic rings may be fused in the compound, or quinoid structures may be coupled with each other in the compound. Specific examples of the compound include compounds each represented by any one of the following formulae (5) to (7).

(5)

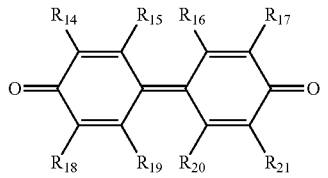

In the formula (5), $R_{14}$ to $R_{21}$ each independently represent a hydrogen atom, or a substituted or unsubstituted alkyl group, or two arbitrary adjacent groups of R's ($R_{14}$ to $R_{21}$) may be bonded to each other so as to be cyclic, examples of the substituent which the alkyl group may have include a hydroxyl group and a carboxyl group, and, when two arbitrary adjacent groups of R's ($R_{14}$ to $R_{21}$) are bonded to each other so as to be cyclic, the cyclic portion may have an alkyl group.

(6)

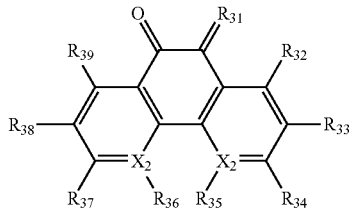

In the formula (6), $R_{31}$ represents an oxygen atom or a dicyanomethylene group, $R_{32}$ to $R_{39}$ each independently represent a hydrogen atom, a substituted or unsubstituted alkyl group, a substituted or unsubstituted aryl group, a halogen group, or a nitro group, examples of the substituent which the alkyl group may have include a hydroxyl group and a carboxyl group, examples of the substituent which the aryl group may have include an alkyl group, a nitro group, a cyano group, a carboxyl group, a halogen group, and a haloalkyl group, $X_2$ represents a carbon atom or a nitrogen atom, and, when $X_2$ represents a nitrogen atom, neither $R_{35}$ nor $R_{36}$ is present.

(7)

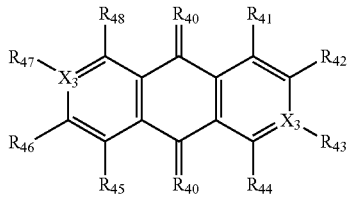

In the formula (7), $R_{40}$ represents a hydrogen atom or a dicyanomethylene group, $R_{41}$ to $R_{48}$ each independently represent a hydrogen atom, a hydroxyl group, a carboxyl group, a halogen group, or a substituted or unsubstituted alkyl group, examples of the substituent which the alkyl group may have include a hydroxyl group and a carboxyl group, $X_3$ represents a carbon atom or a nitrogen atom, and, when $X_3$ represents a nitrogen atom, neither $R_{43}$ nor $R_{47}$ is present.

The cyclopentadienylidene-based compound is, for example, a compound having a cyclopentadienylidene structure, and aromatic rings may be fused in the compound. Specific examples of the compound include compounds each represented by the following formula (8).

(8)

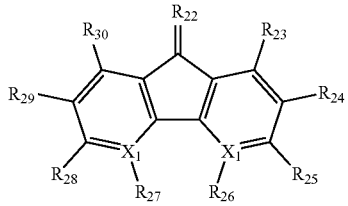

In the formula (8), $R_{22}$ represents an oxygen atom, a dicyanomethylene group, or an anilidene group, the anilidene group may have an alkyl group, $R_{23}$ to $R_{30}$ each independently represent a hydrogen atom, an ester group, or a nitro group, $X_1$ represents a carbon atom or a nitrogen atom, and, when $X_1$ represents a nitrogen atom, neither $R_{26}$ nor $R_{27}$ is present.

The azo-based compound is, for example, a compound having an azo group. Specific examples of the compound include compounds each represented by the following formula (9).

$$R_{49}—N{=}N—R_{51}—N{=}N—R_{50} \quad (9)$$

In the formula (9), $R_{51}$ represents a fluorenonediyl group, a diphenyloxadiazolediyl group, or an azoxybenzenediyl group, and $R_{49}$ and $R_{50}$ each independently represent a substituent having a structure represented by the following formula (10) or (11).

(10)

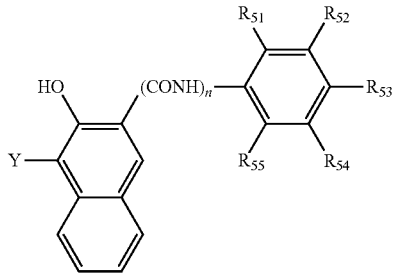

(11)

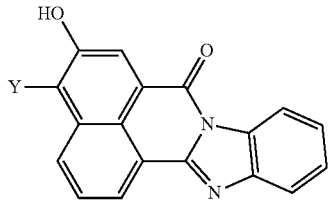

In the formulae (10) and (11), $R_{51}$ to $R_{55}$ each independently represent a substituted or unsubstituted alkyl group, or a halogen group, examples of the substituent which the alkyl group may have include a hydroxyl group and a carboxyl group, n represents 1 or 2, and Y represents a bonding site where each of $R_{49}$ and $R_{50}$ is bonded to an azo group in the formula (9).

Exemplary compounds of the organic electron-transporting substance are shown below. However, the present invention is not limited to these examples.

(E1)
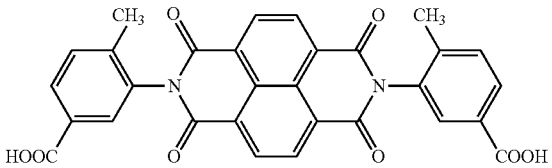
(E2)
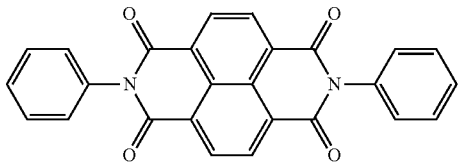
(E3)
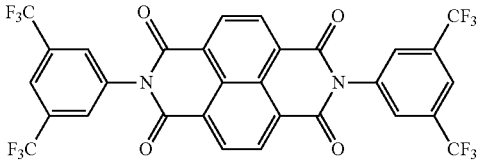
(E4)
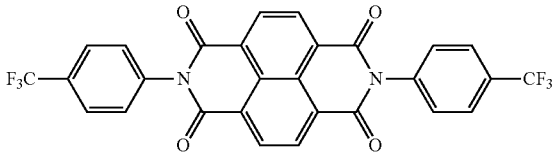
(E5)
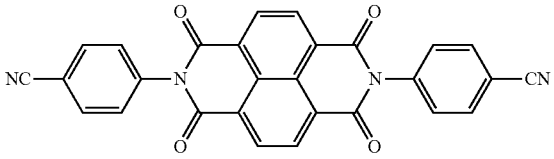
(E6)
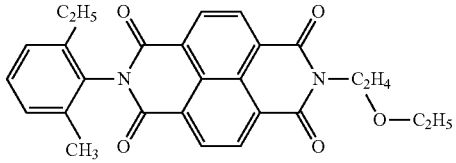
(E7)
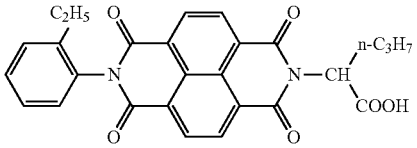
(E8)
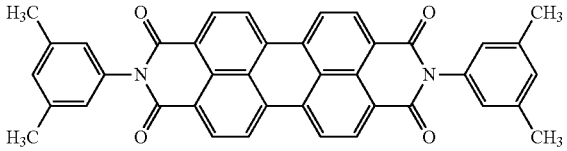
(E9)
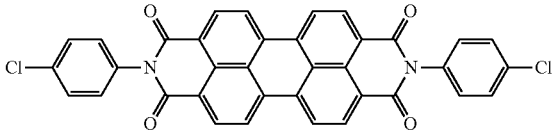
(E10)
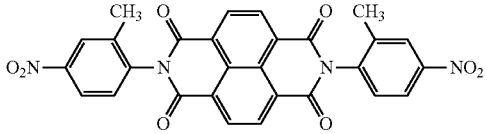
(E11)
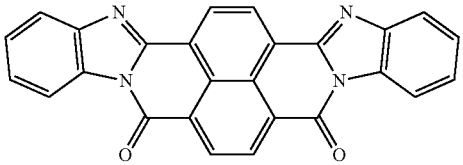
(E12)
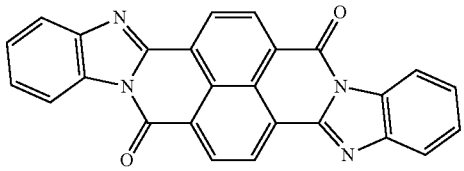
(E13)
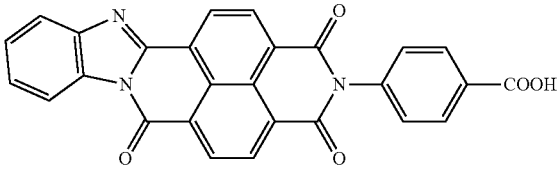
(E14)
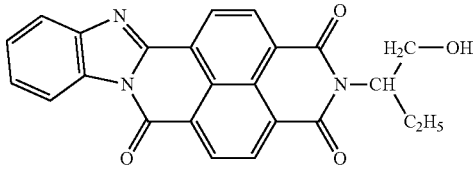
(E15)
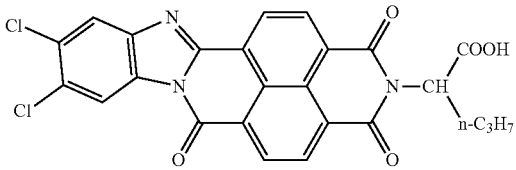
(E16)
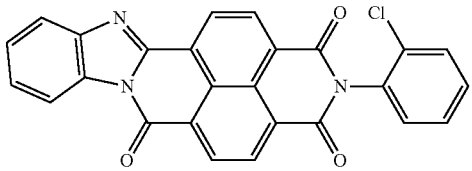

-continued
(E17)
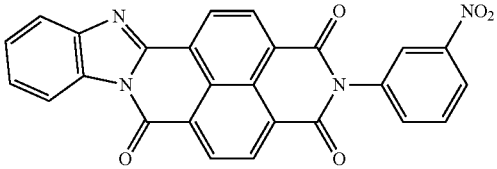
(E18)
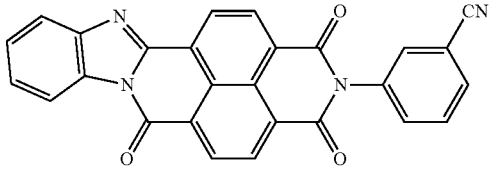
(E19)
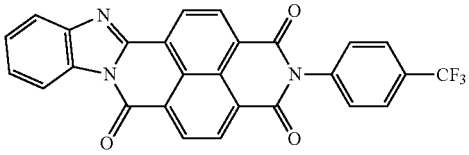
(E20)
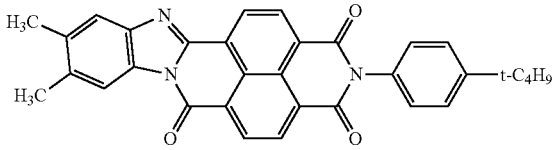
(E21)
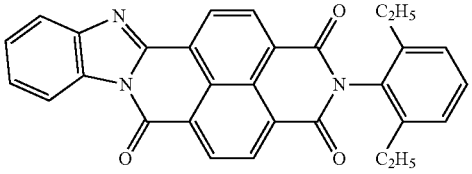
(E22)
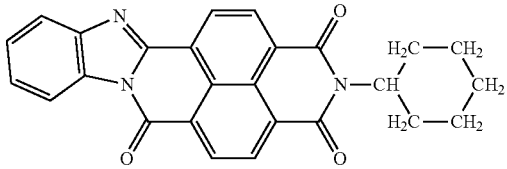
(E23)
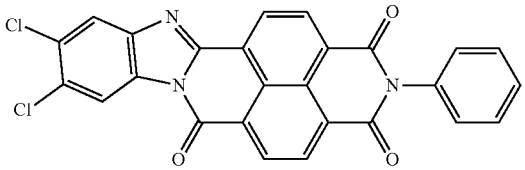
(E24)
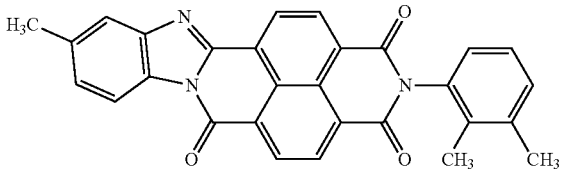
(E25)
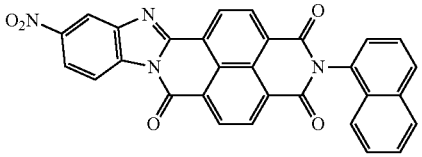
(E26)
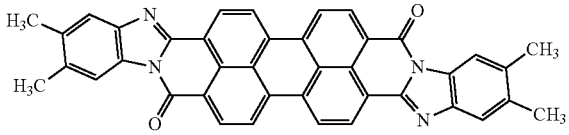
(E27)
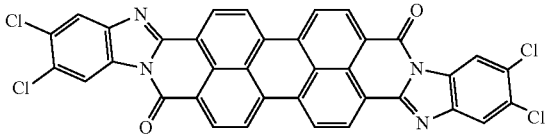
(E28)
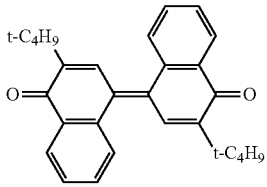
(E29)
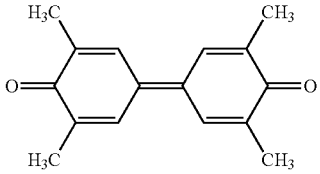
(E30)
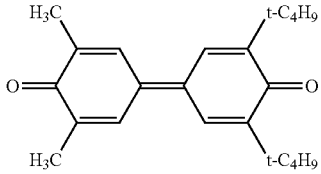
(E31)
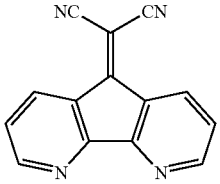
(E32)
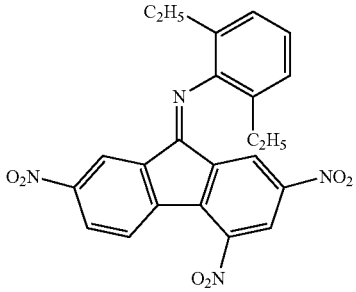

-continued
(E33)
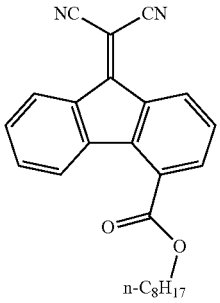
(E34)
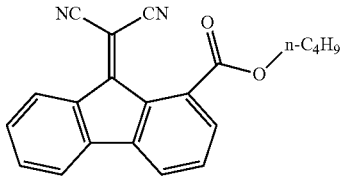
(E35)
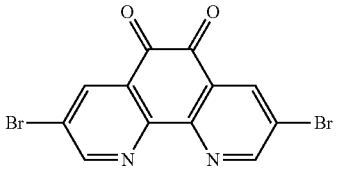
(E36)
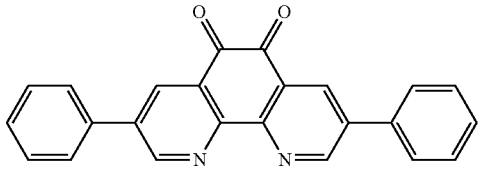
(E37)
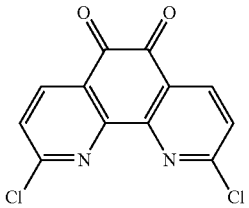
(E38)
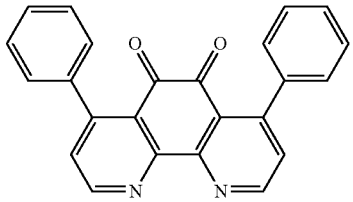
(E39)
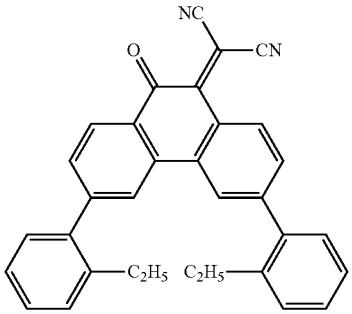
(E40)
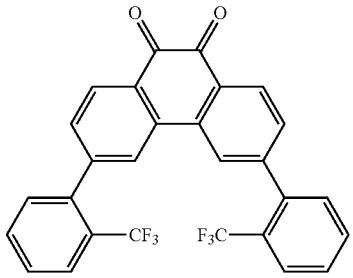
(E41)
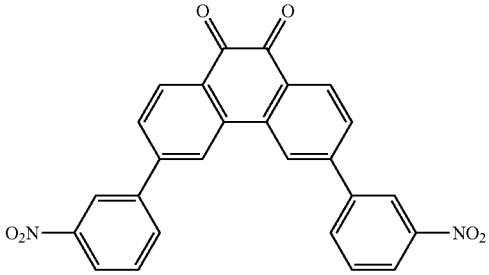
(E42)
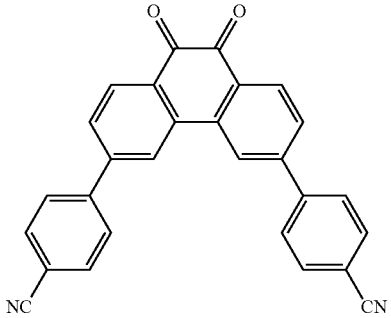

-continued
(E43)
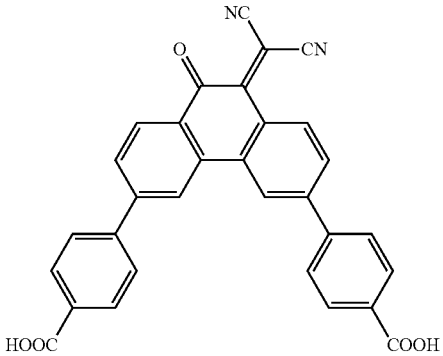
(E44)
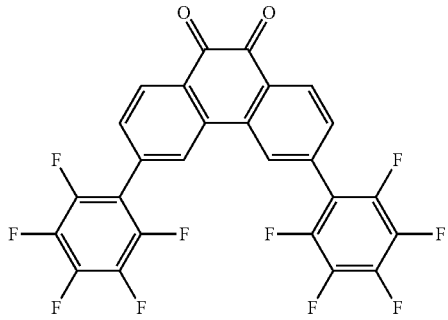
(E45)
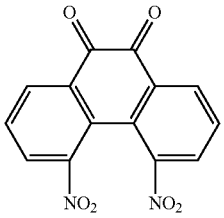
(E46)
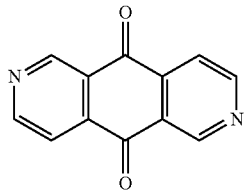
(E47)
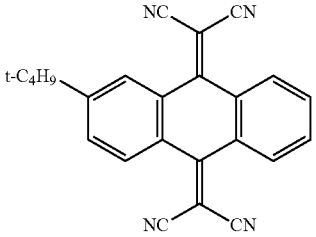
(E48)
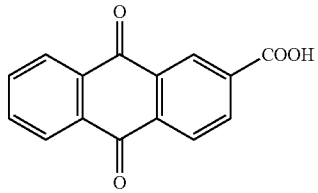
(E49)
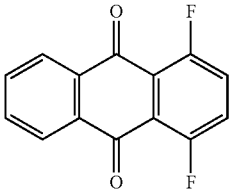
(E50)
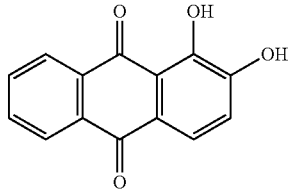
(E51)
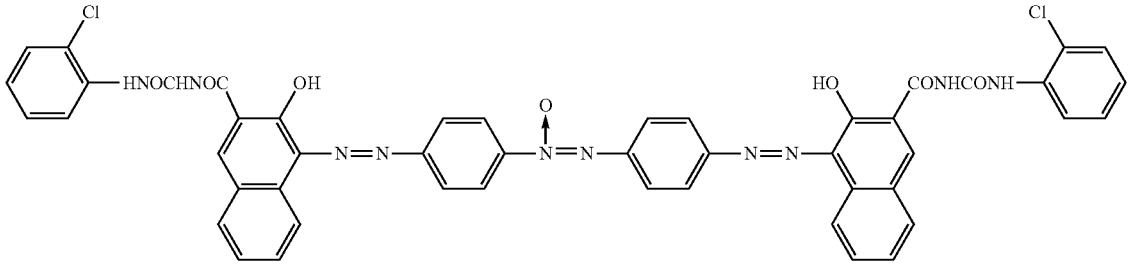
(E52)
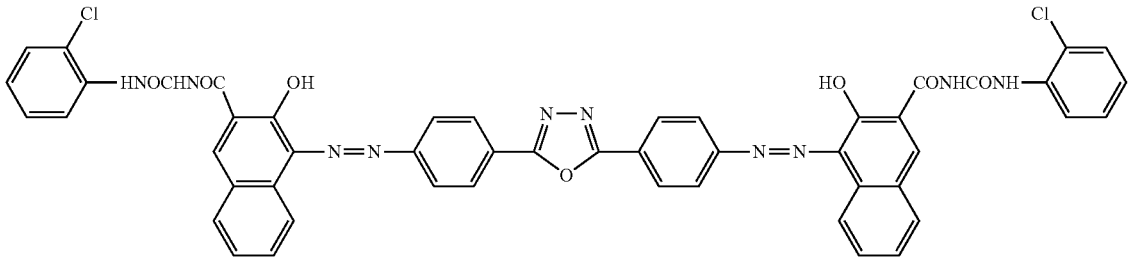

-continued
(E53)
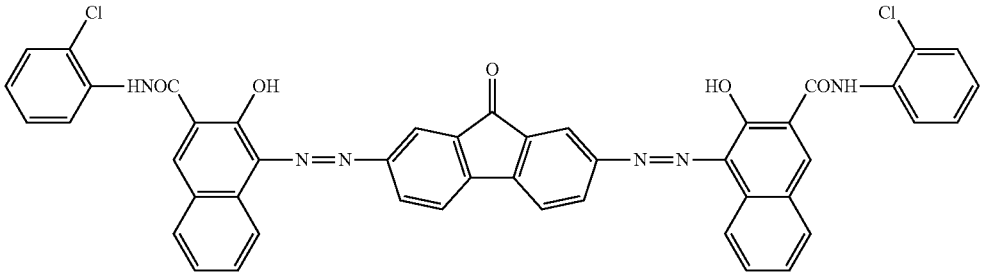
(E54)
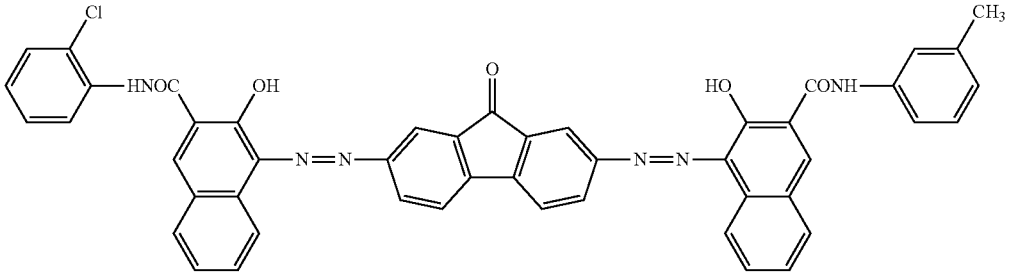
(E55)
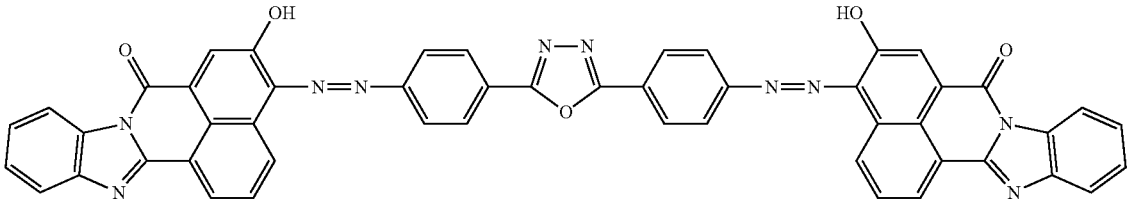
(E56)
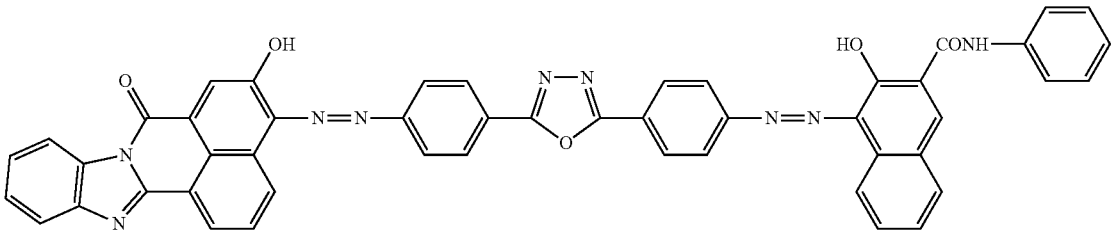
(E57)
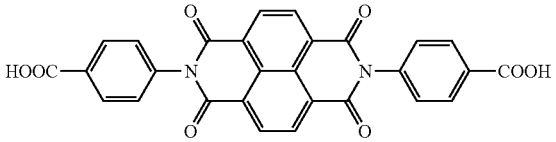
(E58)
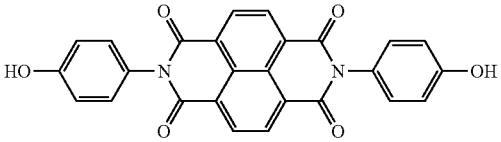
(E59)
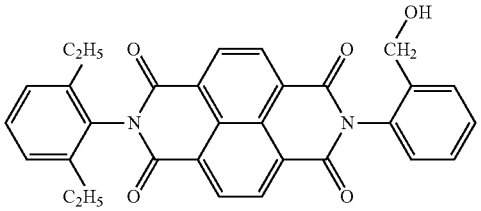
(E60)
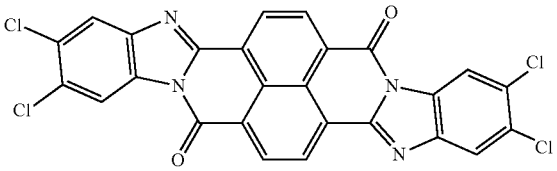
(E61)
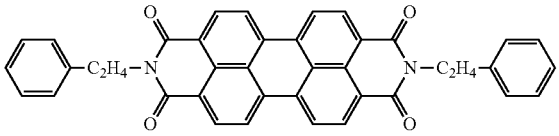
(E62)
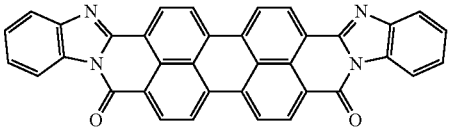

-continued (E63)

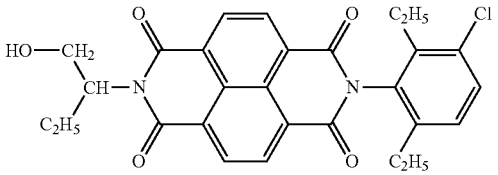

(E64)

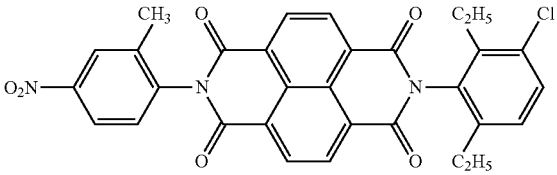

(E65)

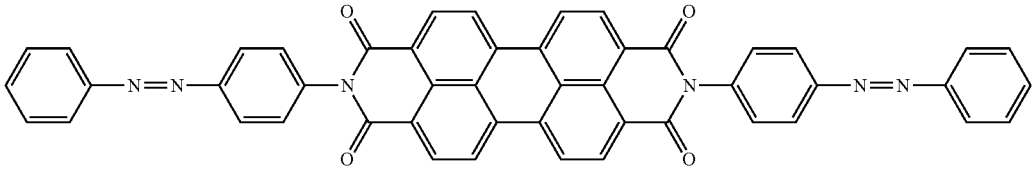

(E66)

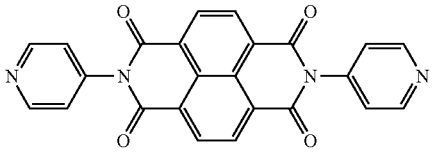

(E67)

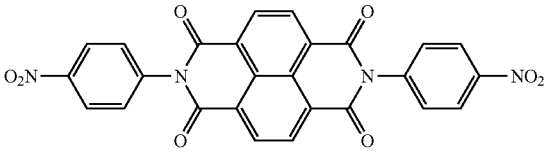

Each of those organic electron-transporting substances may be compatible with the polyolefin resin of the intermediate layer, or particles formed of the molecules of the organic electron-transporting substance may be dispersed in the polyolefin resin of the intermediate layer.

It should be noted that the above organic electron-transporting substance is available as described below.

A compound represented by the formula (1) can be synthesized by employing any one of the known synthesis methods described in, for example, U.S. Pat. Nos. 4,442,193, 4,992,349, and 5,468,583. The compound can be synthesized by, for example, a reaction between a naphthalene tetracarboxylic dianhydride and a monoamine derivative available as reagents from Tokyo Chemical Industry Co., Ltd., Sigma-Aldrich Japan, or Johnson Matthey Japan Incorporated or between a perylene tetracarboxylic dianhydride and the monoamine derivative available as reagents from any such company.

A compound represented by the formula (2) or (3) can be synthesized by employing any one of the known synthesis methods described in, for example, U.S. Pat. Nos. 4,442,193, 4,992,349, and 5,468,583 with a 1,2-dianiline derivative instead of the monoamine derivative. The 1,2-dianiline derivative is available as a reagent from, for example, Tokyo Chemical Industry Co., Ltd., Sigma-Aldrich Japan, or Johnson Matthey Japan Incorporated.

A compound represented by the formula (4) can be synthesized by employing any one of the known synthesis methods described in, for example, Japanese Patent Application Laid-open No. 2004-093791 and Japanese Patent Application Laid-open No. Hei 7-89962. The compound can be synthesized by, for example, a reaction among a naphthalene tetracarboxylic dianhydride, a 1,2-dianiline derivative, and an amine derivative available as reagents from Tokyo Chemical Industry Co., Ltd., Sigma-Aldrich Japan, or Johnson Matthey Japan Incorporated or among a perylene tetracarboxylic dianhydride, the 1,2-dianiline derivative, and the amine derivative available as reagents from any such company.

A compound represented by the formula (5) can be synthesized by employing any one of the known synthesis methods described in, for example, Japanese Patent Application Laid-open No. Hei 1-206349 and the proceedings of PPCI/Japan Hard Copy '98, p 207 (1998). The compound can be synthesized by using, for example, a phenol derivative available as a reagent from Tokyo Chemical Industry Co., Ltd. or Sigma-Aldrich Japan as a raw material.

Some of the compounds each represented by the formula (6) are available as reagents from, for example, Tokyo Chemical Industry Co., Ltd., Sigma-Aldrich Japan, or Johnson Matthey Japan Incorporated. Alternatively, a compound represented by the formula can be synthesized by any one of the known synthesis methods described in Bull. Chem. Soc. Jpn., Vol. 65, p 116-1011 (1992) and Chem. Educator No. 6, p 227-234 (2001) on the basis of an available phenanthrene derivative or phenanthroline derivative. In addition, a substituent can be introduced into such a compound by, for example, a cross-coupling reaction involving the use of a palladium catalyst on the basis of a halide of the phenanthrene derivative or phenanthroline derivative described in any such document. A dicyanomethylene group can also be introduced into such a compound by a reaction between the compound and malononitrile.

Some of the compounds each represented by the formula (7) are available as reagents from, for example, Tokyo Chemical Industry Co., Ltd., Sigma-Aldrich Japan, or Johnson Matthey Japan Incorporated. Alternatively, a compound represented by the formula can be synthesized by any one of the known synthesis methods described in Synthesis, Vol. 5, p 388-389 (1988) using an available compound. A dicyanomethylene group can also be introduced into such a compound by a reaction between the compound and malononitrile.

Some of the compounds each represented by the formula (8) are available as reagents from, for example, Tokyo Chemical Industry Co., Ltd., Sigma-Aldrich Japan, or Johnson Matthey Japan Incorporated. Alternatively, a compound represented by the formula can be synthesized by employing any one of the known synthesis methods described in Japanese Patent Application Laid-open No. Hei 5-279582, U.S. Pat. No. 4,562,132, and Japanese Patent Application Laid-open No. Hei 7-70038 with any one of a fluorenone derivative, an aniline derivative, malononitrile, and any other compound which are available.

A compound represented by the formula (9) can be synthesized by employing a known synthesis method described in, for example, Journal of the Imaging Society of Japan, Vol. 37, No. 3, p 280-288 (1998).

When the intermediate layer is formed of multiple layers, some of the layers may be free of the polyolefin resin and the organic electron-transporting substance.

In this case, examples of the binder resin used for forming the layer include polyvinyl alcohol, polyvinyl acetal, polyethylene oxide, ethyl cellulose, methyl cellulose, polyamide, polyamide acid, polyurethane, polyimide, a melamine resin, a phenol resin, an epoxy resin, an alkyd resin, polymerized products of various metallic chelate compounds made of, for example, titanium and zirconium, and polymerized products of various metallic alkoxides.

In addition, the intermediate layer may contain conductive particles such as: particles of various metals such as gold, silver, and aluminum; ITO particles; tin oxide particles; conductive titanium oxide particles; zinc oxide particles; and barium sulfate particles and titanium oxide particles each provided with a conductive coat layer formed of, for example, tin oxide.

For example, a dip coating method, a spray coating method, a curtain coating method, or a spin coating method is known as a method of applying an application liquid for producing those electrophotographic photosensitive members; the dip coating method is preferable from the viewpoints of the efficiency with which the electrophotographic photosensitive members are produced and the productivity of the electrophotographic photosensitive members.

The process cartidge of the present invention is a process cartridge, including: the electrophotographic photosensitive member of the present invention; and at least one device selected from the group consisting of charging device, developing device, transferring device, and cleaning device, in which the process cartridge integrally supports the electrophotographic photosensitive member and the at least one device, and is attachable to and detachable from a main body of an electrophotographic apparatus.

The electrophotographic apparatus of the present invention is an electrophotographic apparatus, including: the electrophotographic photosensitive member of the present invention; charging device; exposing device; developing device; and transferring device.

Hereinafter, a process cartridge and an electrophotographic apparatus of the present invention are described with reference to a figure.

FIG. 1 illustrates the outline constitution of the electrophotographic apparatus having the process cartridge including the electrophotographic photosensitive member of the present invention.

In FIG. 1, a drum-shaped electrophotographic photosensitive member 1 of the present invention is rotated around a rotating shaft 2 in the direction indicated by an arrow at a predetermined circumferential speed. The circumferential surface of the electrophotographic photosensitive member 1 is uniformly charged to a predetermined positive or negative potential by charging device 3 in the rotation process, and then receives exposure light 4 from exposing device (not shown) such as slit exposure or laser beam scanning exposure. Thus, electrostatic latent images are sequentially formed on the circumferential surface (surface) of the electrophotographic photosensitive member 1.

Next, the electrostatic latent images thus formed are each developed with toner from developing device 5 (which may be of a contact type, or may be of a non-contact type). The toner images formed by the development are sequentially transferred by transferring device 6 onto a transfer material 7 taken out of a paper-feeding portion (not shown) to be fed to a portion between the electrophotographic photosensitive member 1 and the transferring device 6 in synchronization with the rotation of the electrophotographic photosensitive member 1.

The transfer material 7 onto which the images have been transferred is separated from the surface of the electrophotographic photosensitive member, and is then introduced into fixing device 8 to undergo image fixation. As a result, the transfer material as a copy is printed out of the apparatus.

Transfer residual toner is removed from the surface of the electrophotographic photosensitive member 1 after the transfer of the images by cleaning device 9 so that the surface may be cleaned. Further, the surface is subjected to an antistatic treatment by pre-exposure light from pre-exposing device (not illustrated) before the electrophotographic photosensitive member is repeatedly used for image formation.

The charging device 3 may be a scorotron charging device or corotron charging device utilizing corona discharge, or a contact type charging device of, for example, a roller shape, blade shape, or brush shape may be used as the charging device.

In the present invention, the following procedure may be adopted: two or more of the components including the electrophotographic photosensitive member 1, the charging device 3, the developing device 5, the transferring device 6, and the cleaning device 9 described above are integrally bonded to form a process cartridge, and the process cartridge is formed so as to be attachable to and detachable from the main body of the electrophotographic apparatus such as a copying machine or a laser beam printer.

For example, at least one of the charging device 3, the developing device 5, and the cleaning device 9, and the electrophotographic photosensitive member 1 can be integrally supported to serve as a process cartridge 10 attachable to and detachable from the main body of the apparatus with the aid of guide such as rails 11 and 12 of the main body of the apparatus.

In addition, when the electrophotographic apparatus is a copying machine or a printer, the exposure light 4 is light reflected from or transmitting through an original copy, or light applied by, for example, scanning with laser beams performed in accordance with a signal obtained by reading the original copy with a sensor and turning the read original copy into the signal, or the driving of an LED array or liquid crystal shutter array.

The electrophotographic photosensitive member of the present invention is applicable to general electrophotographic apparatuses such as a copying machine, a laser printer, an LED printer, and a liquid crystal shutter type printer; furthermore, the electrophotographic photosensitive member is applicable to a wide variety of apparatuses each applying electrophotography such as a display, a recording apparatus, a light printing apparatus, a plate-making apparatus, and a facsimile.

Hereinafter, the present invention is described in more detail by way of examples. However, an embodiment of the present invention is not limited to those examples. It should be noted that the term "part(s)" in the following description refers to "part(s) by mass."

PRODUCTION EXAMPLE 1

Polyolefin Resin A

First, 280 parts of a polyolefin resin (VESTPLAST 708 manufactured by Evonik Degussa GmbH) were molten by heating under a nitrogen atmosphere in a four-necked flask. After that, the temperature in the system was kept at 170° C., and 32 parts of maleic anhydride as an unsaturated carboxylic acid and 5 parts of dicumyl peroxide as a radical generator were each added to the resin over 1 hour while the resin was reacted. After that, the mixture was subjected to a reaction for 1 hour. After the completion of the reaction, the resultant reaction product was loaded into 5,000 parts of acetone so that the resin might be precipitated. The resin was further washed with the same amount of acetone four times so that unreacted maleic anhydride might be removed. After that, the remainder was dried under reduced pressure in a vacuum dryer. As a result, a polyolefin resin A was obtained.

Next, 60 parts of the polyolefin resin A, 60 parts of isopropyl alcohol, 1.2 equivalents of triethylamine with respect to the carboxyl groups of maleic anhydride units in the resin, and 170 parts of distilled water were loaded into a sealable, pressure-resistant glass container provided with a stirring machine and a heater and having a volume of one liter, and the mixture was stirred while the rotational speed of a stirring blade was set to 300 rpm. As a result, no resin precipitate was observed at the bottom of the container, but the resin was observed to be in a floating state. Here, 15 minutes after the observation, the heater was turned on to heat the mixture while the state was maintained. Then, the mixture was stirred for an additional 60 minutes while the temperature in the system was kept at 140° C. After that, the system was cooled to room temperature (a temperature of about 25° C.) with air while the mixture was stirred with the rotational speed kept at 300 rpm. After that, the mixture was filtrated with a 300-mesh stainless filter (wire diameter 0.035 mm, plain weave) under pressure (at an air pressure of 0.2 MPa). As a result, a milky yellow, uniform aqueous dispersion of the polyolefin resin A having a solid concentration of 20 mass % was obtained.

The constitution of the polyolefin resin A was as follows: the resin had a ratio "((A1): $R^{11}=R^{12}=R^{13}=H$, $R^{14}$=methyl group in the formula (11))/((A1): $R^{11}=R^{12}=R^{13}=H$, $R^{14}$=ethyl group in the formula (11))/((A1): $R^{11}=R^{12}=R^{13}=R^{14}=H$ in the formula (11))/((A2): $R^{25}=R^{26}=H$, $X^{21}$=—$Y^{22}COOCOY^{23}$— ($Y^{22}=Y^{23}$=single bond) in the formula (22))" of 11/61/24/4 (mass %).

PRODUCTION EXAMPLE 2

Polyolefin Resin B

An aqueous dispersion of a polyolefin resin B was obtained in the same manner as in the production of the polyolefin resin A except that a polyolefin resin (VESTPLAST 408 manufactured by Evonik Degussa GmbH) was used. The constitution of the polyolefin resin B was as follows: the resin had a ratio "((A1): $R^{11}=R^{12}=R^{13}=H$, $R^{14}$=methyl group in the formula (11))/((A1): $R^{11}=R^{12}=R^{13}=H$, $R^{14}$=ethyl group in the formula (11))/((A1): $R^{11}=R^{12}=R^{13}=R^{14}=H$ in the formula (11))/((A2): $R^{25}=R^{26}=H$, $X^{21}$=—$Y^{22}COOCOY^{23}$— ($Y^{22}=Y^{23}$=single bond) in the formula (22))" of 5/11/78/6 (mass %).

PRODUCTION EXAMPLE 3

Polyolefin Resin C

Next, 75 parts of the polyolefin resin (BONDINE HX-8290, manufactured by Sumitomo Chemical Company, Limited), 90 parts of isopropanol, 1.2 equivalents of triethylamine with respect to the carboxyl groups of maleic anhydride units in the resin, and 200 parts of distilled water were loaded into a sealable, pressure-resistant glass container provided with a stirring machine and a heater and having a volume of one liter, and the mixture was stirred while the rotational speed of a stirring blade was set to 300 rpm. As a result, no resin precipitate was observed at the bottom of the container, but the resin was observed to be in a floating state. Here, 15 minutes after the observation, the heater was turned on to heat the mixture while the state was maintained. Then, the mixture was stirred for an additional 60 minutes while the temperature in the system was kept at 145° C. After that, the system was cooled to room temperature (a temperature of about 25° C.) with water while the mixture was stirred with the rotational speed kept at 300 rpm. After that, the mixture was filtrated with a 300-mesh stainless filter (wire diameter 0.035 mm, plain weave) under pressure (at an air pressure of 0.2 MPa). As a result, a milky white, uniform aqueous dispersion of the polyolefin resin C having a solid concentration of 20 mass % was obtained. The constitution of the polyolefin resin C was as follows: the resin had a ratio "((A1): $R^{11}=R^{12}=R^{13}=R^{14}=H$ in the formula (11))/((A2): $R^{25}=R^{26}$==H, $X_{21}$=—$Y^{22}COOCOY^{23}$— ($Y^{22}=Y^{23}$=single bond) in the formula (22))/(repeating structural units each represented by the formula (31): $R^{31}=H$, $R^{41}$=ethyl group)" of 80/2/18 (mass %).

PRODUCTION EXAMPLE 4

Polyolefin Resin D

An aqueous dispersion of a polyolefin resin D was obtained in the same manner as in the production of the polyolefin resin C except that a BONDINE HX-8210 (manufactured by Sumitomo Chemical Company, Limited) was used instead of the BONDINE HX-8290. The constitution of the polyolefin resin D was as follows: the resin had a ratio "((A1): $R^{11}=R^{12}=R^{13}=R^{14}=H$ in the formula (11))/((A2): $R^{25}=R^{26}=H$, $X^{21}$=—$Y^{22}COOCOY^{23}$—($Y^{22}=Y^{23}$=single bond) in the formula (22))/(repeating structural units each represented by the formula (31): $R^{31}=H$, $R^{41}$=ethyl group)" of 91/3/6 (mass %).

PRODUCTION EXAMPLE 5

Polyolefin Resin E

An aqueous dispersion of a polyolefin resin E was obtained in the same manner as in the production of the polyolefin resin C except that a PRIMACOR 5980I (manufactured by Dow Chemical Co.) was used instead of the BONDINE HX-8290. The constitution of the polyolefin resin E was as follows: the resin had a ratio "((A1): $R^{11}=R^{12}=R^{13}=R^{14}=H$ in the formula (11))/((A2): $R^{21}=R^{22}=R^{23}=H$, $R^{24}$=—$Y^{21}COOH$ ($Y^{21}$=single bond) in the formula (21))" of 80/20 (mass %).

PRODUCTION EXAMPLE 6

Polyolefin Resin F

An aqueous dispersion of a polyolefin resin F was obtained in the same manner as in the production of the polyolefin resin C except that a BONDINE AX-8390 (manufactured by Sumitomo Chemical Company, Limited) was used instead of the BONDINE HX-8290. The constitution of the polyolefin resin F was as follows: the resin had a ratio "((A1): $R^{11}=R^{12}=R^{13}=R^{14}=H$ in the formula (11))/((A2): $R^{25}=R^{26}=R^{13}=H$, $X^{21}$=—$Y^{22}COOCOY^{23}$— ($Y^{22}=Y^{23}$=single bond) in the formula (22))/(repeating structural units each represented by the formula (31): $R^{31}$=H, $R^{41}$=ethyl group)" of 68/2/30 (mass %).

PRODUCTION EXAMPLE 7

Polyolefin Resin G

An aqueous dispersion of a polyolefin resin G was obtained in the same manner as in Production Example 1 except that the following procedure was adopted. First, 280 parts of a polyolefin resin (VESTPLAST 708 manufactured by Evonik Degussa GmbH) were molten by heating. After that, the temperature in the system was kept at 180° C., and 120 parts of maleic anhydride and 10 parts of dicumyl peroxide were each added to the resin over 1 hour while the resin was stirred. After that, the mixture was subjected to a reaction for 3 hours. The constitution of the polyolefin resin G was as follows: the resin had a ratio "((A1): $R^{11}$=$R^{12}$=$R^{13}$=$R^{14}$=H in the formula (11))/((A1): $R^{11}$=$R^{12}$=$R^{13}$=H, $R^{14}$=methyl group in the formula (11))/((A1): $R^{11}$=$R^{12}$=$R^{13}$=H, $R^{14}$=ethyl group in the formula (11))/((A2): $R^{25}$=$R^{26}$=$R^{13}$=H, $X^{21}$=—$Y^{22}$COOCO$Y^{23}$—($Y^{22}$=$Y^{23}$=single bond) in the formula (22))" of 6/32/12/50 (mass %).

PRODUCTION EXAMPLE 8

Polyolefin Resin H

An aqueous dispersion of a polyolefin resin H was obtained in the same manner as in Production Example 7 except that 32 parts of maleic anhydride and 120 parts of 1-octene were added instead of 120 parts of maleic anhydride. The constitution of the polyolefin resin H was as follows: the resin had a ratio "((A1): $R^{11}$=$R^{12}$=$R^{13}$=$R^{14}$=H in the formula (11))/((A1): $R^{11}$=$R^{12}$=$R^{13}$=H, $R^{14}$=methyl group in the formula (11))/((A1): $R^{11}$=$R^{12}$=$R^{13}$=H, $R^{14}$=ethyl group in the formula (11))/((A1): $R^{11}$=$R^{12}$=$R^{13}$=H, $R^{14}$=n-hexyl group in the formula (11))/((A2): $R^{25}$=$R^{26}$=H, $X^{21}$=—$Y^{22}$COOCO$Y^{23}$— ($Y^{22}$=$Y^{23}$=single bond) in the formula (22))" of 6/30/11/49/4 (mass %).

PRODUCTION EXAMPLE 9

Polyolefin Resin I

An aqueous dispersion of a polyolefin resin I was obtained in the same manner as in Production Example 2 except that citraconic anhydride was added instead of maleic anhydride. The constitution of the polyolefin resin I was as follows: the resin had a ratio "((A1): $R^{11}$=$R^{12}$=$R^{13}$=H, $R^{14}$=methyl group in the formula (11))/((A1): $R^{11}$=$R^{12}$=$R^{13}$=H, $R^{14}$=ethyl group in the formula (11))/((A1): $R^{11}$=$R^{12}$=$R^{13}$=$R^{14}$=H in the formula (11))/((A2): $R^{25}$=H, $R^{26}$=methyl group, $X^{21}$=—$Y^{22}$COOCO$Y^{23}$— ($Y^{22}$=$Y^{23}$=single bond) in the formula (22))" of 5/11/78/6 (mass %).

PRODUCTION EXAMPLE 10

Polyolefin Resin J

An aqueous dispersion of a polyolefin resin J was obtained in the same manner as in Production Example 2 except that cinnamic acid was added instead of maleic anhydride. The constitution of the polyolefin resin J was as follows: the resin had a ratio "((A1): $R^{11}$=$R^{12}$=$R^{13}$=H, $R^{14}$=methyl group in the formula (11))/((A1): $R^{11}$=$R^{12}$=$R^{13}$=H, $R^{14}$=ethyl group in the formula (11))/((A1): $R^{11}$=$R^{12}$=$R^{13}$=$R^{14}$=H in the formula (11))/((A2): $R^{21}$=phenyl group, $R^{22}$=$R^{23}$=H, $R^{24}$=—$Y^{21}$COOH ($Y^{21}$=single bond) in the formula (21))" of 5/11/78/6 (mass %).

PRODUCTION EXAMPLE 11

Polyolefin Resin K

An aqueous dispersion of a polyolefin resin K was obtained in the same manner as in Production Example 2 except that 3-octenoic acid was added instead of maleic anhydride. The constitution of the polyolefin resin K was as follows: the resin had a ratio "((A1): $R^{11}$=$R^{12}$=$R^{13}$=H, $R^{14}$=methyl group in the formula (11))/((A1): $R^{11}$=$R^{12}$=$R^{13}$=H, $R^{14}$=ethyl group in the formula (11))/((A1): $R^{11}$=$R^{12}$=$R^{13}$=$R^{14}$=H in the formula (11))/((A2): $R^{21}$=n-butyl group, $R^{22}$=$R^{23}$=H, $R^{24}$=—$Y^{21}$COOH ($Y^{21}$=methylene group) in the formula (21))" of 5/11/78/6 (mass %).

PRODUCTION EXAMPLE 12

Polyolefin Resin L

An aqueous dispersion of a polyolefin resin L was obtained in the same manner as in Production Example 2 except that 11 parts of maleic anhydride was added. The constitution of the polyolefin resin L was as follows: the resin had a ratio "((A1): $R^{11}$=$R^{12}$=$R^{13}$=H, $R^{14}$=methyl group in the formula (11))/((A1): $R^{11}$=$R^{12}$=$R^{13}$=H, $R^{14}$=ethyl group in the formula (11))/((A1): $R^{11}$=$R^{12}$=$R^{13}$=$R^{14}$=H in the formula (11))/((A2): $R^{25}$=H, $R^{26}$=methyl group, $X^{21}$=—$Y^{22}$COOCO$Y^{23}$— ($Y^{22}$=$Y^{23}$=single bond) in the formula (22))" of 5/12/81/2 (mass %).

EXAMPLE 1

An aluminum cylinder (JIS-A3003, aluminum alloy) having a length of 260.5 mm and a diameter of 30 mm was used as a support (conductive support).

Next, 50 parts of $TiO_2$ particles coated with oxygen defective $SnO_2$ (powder resistivity 120 Ω·cm, $SnO_2$ coverage (mass ratio) 40%) as conductive particles, 40 parts of a phenol resin (Plyophen J-325, manufactured by DIC Corporation, resin solid content 60%) as a binder resin, and 40 parts of methoxypropanol as a solvent were subjected to a dispersion treatment with a sand mill using glass beads each having a diameter of 1 mm for 3 hours. As a result, an application liquid for a conductive layer was prepared. The average particle diameter of the $TiO_2$ particles coated with oxygen defective $SnO_2$ in the application liquid for a conductive layer was 0.33 μm (measured with a CAPA700 manufactured by HORIBA, Ltd. and THF as a dispersion medium at a number of revolutions of 5,000 rpm by a centrifugal sedimentation method).

The application liquid for a conductive layer was applied onto the support by dip coating, and was then dried and thermally cured for 30 minutes at 145° C. As a result, a conductive layer having a thickness of 16 μm was formed.

Next, 40 parts of an organic electron-transporting substance having a structure represented by the formula (E1) synthesized by heating naphthalene-1,4,5,8-tetracarboxylic dianhydride and 3-amino-p-toluic acid in dimethylacetamide, 100 parts of the dispersion of the polyolefin resin C produced in Production Example 3, 500 parts of isopropanol, and 300 parts of distilled water were mixed, and the mixture was subjected to a treatment with a sand mill apparatus using glass beads each having a diameter of 1 mm for 2 hours. Next, the treated product was diluted with 500 parts of isopropanol. As a result, an application liquid for an intermediate layer was prepared. The application liquid for an intermediate layer was applied onto the conductive layer, and was then dried for 20 minutes at 90° C. As a result, an intermediate layer having a thickness of 1.0 μm was formed.

Next, 10 parts of crystalline hydroxygallium phthalocyanine having a strong peak at a Bragg angle (2θ±0.2°) in CuKα characteristic X-ray diffraction of each of 7.5°, 9.9°, 16.3°, 18.6°, 25.1°, and 28.3°, 5 parts of a polyvinyl butyral (trade name: S-Lec BX-1, manufactured by SEKISUI CHEMICAL CO., LTD.), and 260 parts of cyclohexanone were subjected to a dispersion treatment with a sand mill apparatus using glass beads each having a diameter of 1 mm for 1.5 hours. Next, 240 parts of ethyl acetate were added to the treated product. As a result, an application liquid for a charge generation layer was prepared. The application liquid for a charge generation layer was applied onto the intermediate layer by dip coating, and was then dried for 10 minutes at 100° C. As a result, a charge generation layer having a thickness of 0.18 μm was formed.

Next, 7 parts of an amine compound having a structure represented by the following formula (12) and 10 parts of a polyallylate having a repeating structural unit represented by the following formula (13) and a weight-average molecular weight (Mw) of 100,000 (measured with a gel permeation chromatograph "HLC-8120" manufactured by TOSOH CORPORATION and calculated in terms of polystyrene) were dissolved in a mixed solvent containing 30 parts of dimethoxymethane and 70 parts of chlorobenzene. As a result, an application liquid for a hole transport layer was prepared.

(12)

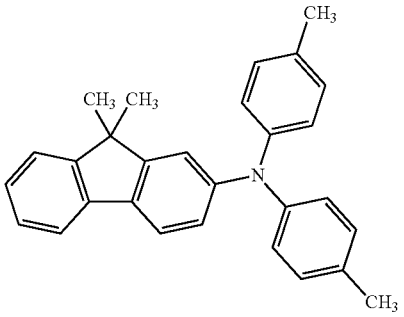

(13)

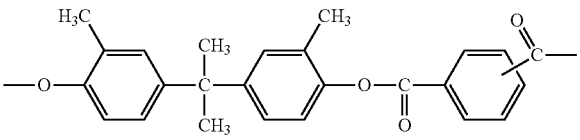

The application liquid for a hole transport layer was applied onto the charge generation layer by dip coating, and was then dried for 40 minutes at 120° C. As a result, a hole transport layer having a thickness of 20 μm was formed. Thus, an electrophotographic photosensitive member using the hole transport layer as its surface layer was produced.

The thickness of each of the intermediate layer and the hole transport layer was measured as described below. An aluminum sheet was wound around an aluminum cylinder having the same dimensions as those described above, and a layer was formed under the same conditions as those described above. Thicknesses at six points of the central portion of the resultant sample were measured with a dial gauge (2109FH manufactured by Mitutoyo Corporation), and the average of the measured values was calculated. The thickness of the charge generation layer was measured as described below. A portion measuring 100 mm by 50 mm was cut out of the central portion of a layer sample formed in the same manner as that described above, and the thickness was calculated from the weights of the layer before and after being wiped with acetone (calculated at a density of 1.3 g/cm$^3$).

The produced electrophotographic photosensitive member was mounted on a laser beam printer LBP-2510 manufactured by Canon Inc. under an environment having a temperature of 23° C. and a humidity of 50% RH, and was then subjected to a surface potential evaluation and an image evaluation at an initial stage and after 3,000-sheet passing duration. Details about the evaluations are as described below.

The produced electrophotographic photosensitive member was mounted on the process cartridge for a cyan color of the LBP-2510. Then, the cyan process cartridge was mounted on its station, and images were output. The surface potential of the drum (electrophotographic photosensitive member) was set so that an initial dark potential might be −550 V and a light potential might be −150 V. The surface potential was measured as follows: the cartridge was reconstructed, a potential probe (model 6000B-8: manufactured by TREK JAPAN) was mounted at the developing position of the cartridge, and a potential at the central portion of the drum was measured with a surface potentiometer (model 344: manufactured by TREK JAPAN).

At the time of paper passing, character images formed of colors each having a print percentage of 1% were output on 3,000 sheets of A4-size plain paper by performing a full-color print operation without turning on pre-exposure.

Figure 2:
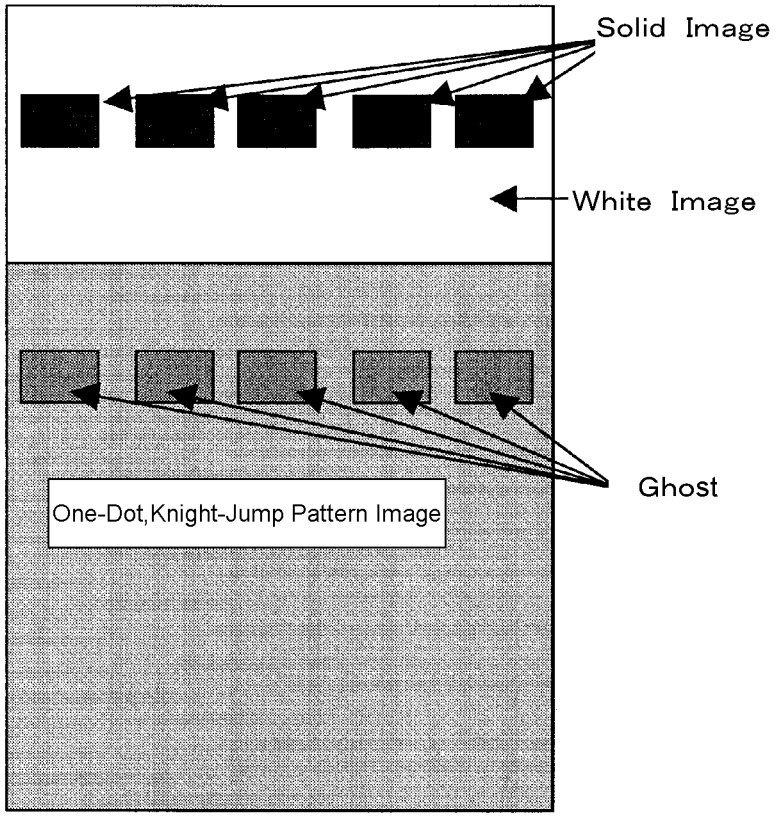
FIG. 2 is a view for describing a print for ghost evaluation used at the time of the evaluation of ghost images.
Figure 3:
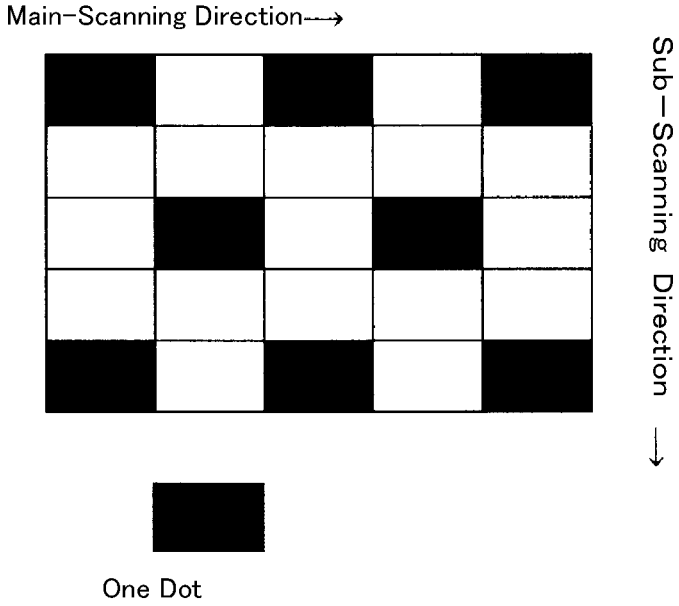
FIG. 3 is a view for describing a one-dot, knight-jump pattern (KEIMA pattern) image of which the halftone portion of the print for ghost evaluation is formed.

Then, at the time of each of the initiation of the evaluation and the completion of the passing of 3,000 sheets, a solid white image was output on a first sheet, and ghost images (as illustrated in FIG. 2, solid square images were output on the leading end of an image, and then a one-dot, knight-jump pattern (KEIMA pattern) halftone image illustrated in FIG. 3 was formed) were continuously output on five sheets. Next, a solid black image was output on one sheet, and then ghost images were output on five sheets again.

The ghost images were evaluated as described below. Density differences between the density of the one-dot, knight-jump pattern (KEIMA pattern) halftone image and the image density of a ghost portion were measured with a spectral densitometer X-Rite 504/508 (manufactured by X-Rite) at ten points of one ghost image, and the average of the ten measured values was defined as a result for one sheet. All the ten ghost images were subjected to the same measurement, and the average of the measured values was determined Table 1 shows the result. The smaller the density difference is, the larger the extent to which ghosts are alleviated is.

EXAMPLE 2

An electrophotographic photosensitive member was produced in the same manner as in Example 1 except that a compound represented by the formula (E3) was used as the organic electron-transporting substance, and the electrophotographic photosensitive member was evaluated in the same manner as in Example 1. The potential of the electrophotographic photosensitive member measured in the same light quantity setting as that of Example 1 was −145 V. The smaller the absolute value of the potential is, the higher the sensitivity of the photosensitive member is. After that, the same potential setting as that of Example 1 was established, and the electrophotographic photosensitive member was evaluated in the same manner as in Example 1. Table 1 shows the results of the evaluations.

EXAMPLES 3 to 20

Electrophotographic photosensitive members were each produced in the same manner as in Example 1 except that products shown in Table 1 were used as the resin and the organic electron-transporting substance, and the electrophotographic photosensitive members were each evaluated in the same manner as in Example 1. Table 1 shows the results.

EXAMPLES 21 and 22

Electrophotographic photosensitive members were each produced in the same manner as in Example 19 except that 14 parts (80 parts) of the organic electron-transporting substance were used in Example 21 (Example 22), and the electrophotographic photosensitive members were each evaluated in the same manner as in Example 19. Table 1 shows the results.

EXAMPLES 23 to 37

Electrophotographic photosensitive members were each produced in the same manner as in Example 1 except that products shown in Table 1 were used as the resin and the organic electron-transporting substance, and the electrophotographic photosensitive members were each evaluated in the same manner as in Example 1. Table 1 shows the results.

COMPARATIVE EXAMPLE 1

An electrophotographic photosensitive member was produced in the same manner as in Example 1 except the following point, and the electrophotographic photosensitive member was evaluated in the same manner as in Example 1. First, a liquid formed of 40 parts of an organic electron-transporting substance having a structure represented by the formula (E37), 20 parts of a polyamide (Toresin EF30T: manufactured by Nagase ChemteX Corporation), 500 parts of n-butyl alcohol, and 300 parts of methanol was subjected to a dispersion treatment with a sand mill apparatus using glass beads each having a diameter of 1 mm for 1.5 hours. Next, the treated product was diluted with 500 parts of methanol. As a result, an application liquid for an intermediate layer was prepared. The application liquid for an intermediate layer was applied onto the conductive layer, and was then dried for 20 minutes at 90° C. As a result, an intermediate layer having a thickness of 1.0 μm was formed. Table 2 shows the results.

COMPARATIVE EXAMPLE 2

An electrophotographic photosensitive member was produced in the same manner as in Example 1 except that an intermediate layer was formed in the same manner as in Comparative Example 2 except that no organic electron-transporting substance was used and dispersion with the sand mill was not performed. Then, the electrophotographic photosensitive member was evaluated in the same manner as in Example 1. Table 2 shows the results.

COMPARATIVE EXAMPLE 3

An electrophotographic photosensitive member was produced in the same manner as in Example 1 except that: a compound represented by the formula (E8) was used as the organic electron-transporting substance; 20 parts of a hydrolyzable silyl group-containing copolymer resin (SA246, manufactured by Sanyo Chemical Industries, Ltd.) were used as a resin; and 1,300 parts of xylene were used instead of distilled water and isopropyl alcohol. Then, the electrophotographic photosensitive member was evaluated in the same manner as in Example 1. Table 2 shows the results.

COMPARATIVE EXAMPLE 4

An electrophotographic photosensitive member was produced in the same manner as in Example 1 except that: a compound represented by the formula (E8) was used as the organic electron-transporting substance; 14 parts of a polyvinyl butyral (S-Lec BM-S, manufactured by SEKISUI CHEMICAL CO., LTD.) and 6 parts of a phenol resin (Plyophen J-325, manufactured by DIC Corporation) were used as resins; and 1,000 parts of n-butyl alcohol and 300 parts of methanol were used instead of distilled water and isopropyl alcohol. Then, the electrophotographic photosensitive member was evaluated in the same manner as in Example 1. Table 2 shows the results.

COMPARATIVE EXAMPLE 5

An electrophotographic photosensitive member was produced in the same manner as in Example 1 except that: a compound represented by the formula (E65) was used as the organic electron-transporting substance; 14 parts of a polyvinyl butyral (S-Lec BM-S, manufactured by SEKISUI CHEMICAL CO., LTD.) and 6 parts of a melamine resin (Cymel 303, manufactured by MT AquaPolymer, Inc.) were used as resins; and 1,000 parts of n-butyl alcohol and 300 parts of methanol were used instead of distilled water and isopropyl alcohol. Then, the electrophotographic photosensitive member was evaluated in the same manner as in Example 1. Table 2 shows the results.

TABLE 1

| Example No. | Resin | Organic electron-transporting substance | Macbeth density difference | Vl (−V) |
|---|---|---|---|---|
| 1 | C | E1 | 0.021 | 150 |
| 2 | C | E3 | 0.020 | 145 |
| 3 | C | E10 | 0.021 | 150 |
| 4 | C | E37 | 0.022 | 160 |
| 5 | C | E40 | 0.021 | 160 |
| 6 | C | E11 | 0.023 | 165 |
| 7 | C | E65 | 0.022 | 150 |
| 8 | D | E3 | 0.026 | 145 |
| 9 | D | E12 | 0.027 | 165 |
| 10 | D | E27 | 0.027 | 165 |
| 11 | D | E43 | 0.029 | 160 |
| 12 | D | E54 | 0.028 | 170 |
| 13 | D | E65 | 0.027 | 150 |
| 14 | B | E26 | 0.031 | 165 |
| 15 | B | E13 | 0.033 | 165 |
| 16 | B | E51 | 0.033 | 170 |
| 17 | B | E46 | 0.034 | 175 |
| 18 | B | E65 | 0.031 | 150 |
| 19 | A | E2 | 0.031 | 150 |
| 20 | A | E14 | 0.033 | 165 |
| 21 | A | E2 | 0.032 | 155 |
| 22 | A | E2 | 0.032 | 150 |
| 23 | A | E65 | 0.031 | 150 |
| 24 | F | E47 | 0.035 | 175 |
| 25 | F | E33 | 0.036 | 185 |
| 26 | F | E30 | 0.037 | 180 |
| 27 | F | E8 | 0.035 | 160 |

TABLE 1-continued

| Example No. | Resin | Organic electron-transporting substance | Macbeth density difference | Vl (−V) |
|---|---|---|---|---|
| 28 | F | E65 | 0.035 | 150 |
| 29 | E | E28 | 0.041 | 180 |
| 30 | E | E65 | 0.040 | 150 |
| 31 | G | E31 | 0.046 | 190 |
| 32 | G | E65 | 0.045 | 150 |
| 33 | H | E65 | 0.037 | 150 |
| 34 | I | E65 | 0.032 | 150 |
| 35 | J | E65 | 0.033 | 155 |
| 36 | K | E65 | 0.033 | 155 |
| 37 | L | E65 | 0.037 | 150 |

TABLE 2

| Comparative Example No. | Resin | Organic electron-transporting substance | Macbeth density difference | Vl (−V) |
|---|---|---|---|---|
| 1 | Polyamide | E37 | 0.056 | 200 |
| 2 | Polyamide | — | 0.061 | 200 |
| 3 | Hydrolyzable silyl group-containing copolymer resin | E8 | 0.070 | 250 |
| 4 | Polyvinyl butyral/phenol resin | E8 | 0.065 | 230 |
| 5 | Polyvinyl butyral/melamine resin | E65 | 0.065 | 220 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-252076, filed Nov. 2, 2009, which is hereby incorporated by reference herein in its entirety.

What is claimed is:

1. An electrophotographic photosensitive member, comprising:

a conductive support;

an intermediate layer; and a photosensitive layer, the intermediate layer and the photosensitive layer being provided on the conductive support in the stated order, wherein:

the intermediate layer contains a polyolefin resin and an organic electron- transporting substance;

the polyolefin resin comprises:

a repeating structural unit represented by the following formula (11);

a repeating structural unit represented by one of the following formulas (21) and (22); and a repeating structural unit represented by any one of the following formulas (31), (32), (33), and (34), and the mass ratio (%) of the repeating structural unit represented by the formula (11) in the polyolefin resin is 75 mass % or more and 94 mass % or less; and the organic electron-transporting substance comprises a compound selected from the group consisting of an imide-based compound represented by the following formula (1), a benzimidazole-based compound represented by the following formula (2), a benzimidazole-based compound represented by the following formula (3), a benzimidazole-based compound represented by the following formula (4), a quinone-based compound represented by the following formula (5), a quinone-based compound represented by the following formula (6), a quinone-based compound represented by the following formula (7), a cyclopentadienylidene-based compound represented by the following formula (8), and derivatives of the compounds:

(11)

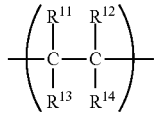

where $R^{11}$ to $R^{14}$ each independently represent a hydrogen atom or an alkyl group;

(21)

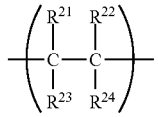

(22)

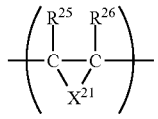

where $R^{21}$ to $R^{24}$ each independently represent a hydrogen atom, an alkyl group, a phenyl group, or a monovalent group represented by —$Y^{21}$COOH where $Y^{21}$ represents a single bond, an alkylene group, or an arylene group, $R^{25}$ and $R^{26}$ each independently represent a hydrogen atom, an alkyl group, or a phenyl group, and $X^{21}$ represents a divalent group represented by —$Y^{22}$COOCO$Y^{23}$—where $Y^{22}$ and $Y^{23}$ each independently represent a single bond, an alkylene group, or an arylene group, provided that at least one of $R^{21}$ to $R^{24}$ represents a monovalent group represented by —$Y^{21}$COOH;

(31)

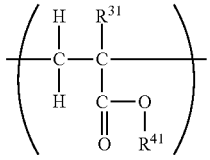

(32)

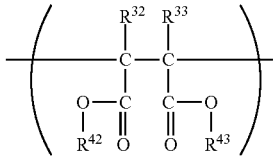

(33)

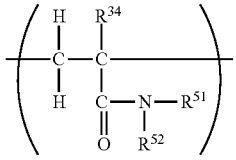

-continued (34)

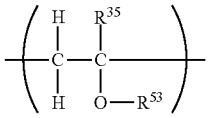

where, in the formulas (31) to (34), $R^{31}$ to $R^{35}$ each independently represent a hydrogen atom or a methyl group, $R^{41}$ to $R^{43}$ each independently represent an alkyl group having 1 to 10 carbon atoms, and $R^{51}$ to $R^{53}$ each independently represent a hydrogen atom or an alkyl group having 1 to 10 carbon atoms;

(1)

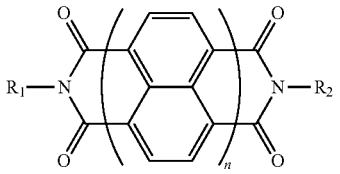

where, in the formula (1), $R_1$ and $R_2$ each independently represent a substituted or unsubstituted alkyl group, or a substituted or unsubstituted aryl group, and n represents 1;

(2)

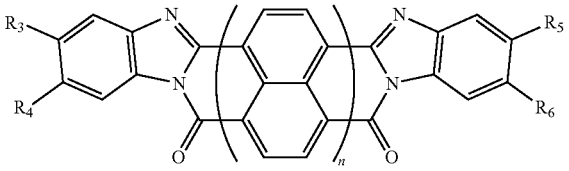

where, in the formula (2), $R_3$ to $R_6$ each independently represent a hydrogen atom, a substituted or unsubstituted alkyl group, or a halogen group, n represents 1;

(3)

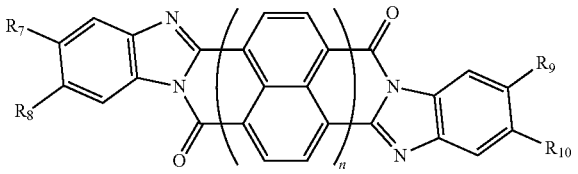

where, in the formula (3), $R_7$ to $R_{10}$ each independently represent a hydrogen atom, a substituted or unsubstituted alkyl group, or a halogen group, n represents 1;

(4)

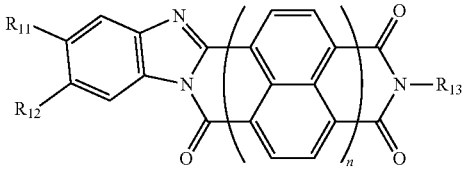

where, in the formula (4), $R_{11}$ and $R_{12}$ each independently represent a hydrogen atom, a substituted or unsubstituted alkyl group, a halogen group, or a nitro group, $R_{13}$ represents a substituted or unsubstituted alkyl group, or a substituted or unsubstituted aryl group, and n represents 1;

(5)

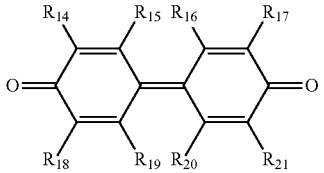

where, in the formula (5), $R_{14}$ to $R_{21}$ each independently represent a hydrogen atom, or a substituted or unsubstituted alkyl group, or two arbitrary adjacent groups of R's ($R_{14}$ to $R_{21}$) may be bonded to each other so as to be cyclic;

(6)

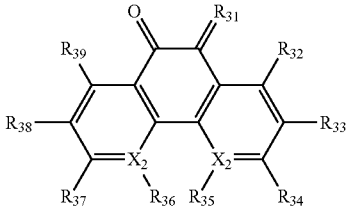

where, in the formula (6), $R_{31}$ represents an oxygen atom or a dicyanomethylene group, $R_{32}$ to $R_{39}$ each independently represent a hydrogen atom, a substituted or unsubstituted alkyl group, a substituted or unsubstituted aryl group, a halogen group, or a nitro group, $X_2$ represents a carbon atom or a nitrogen atom, and, when $X_2$ represents a nitrogen atom, neither $R_{35}$ nor $R_{36}$ is present;

(7)

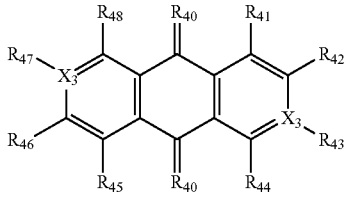

where, in the formula (7), $R_{40}$ represents an oxygen atom or a dicyanomethylene group, $R_{41}$ to $R_{48}$ each independently represent a hydrogen atom, a hydroxyl group, a carboxyl group, a halogen group, or a substituted or unsubstituted alkyl group, $X_3$ represents a carbon atom or a nitrogen atom, and, when $X_3$ represents a nitrogen atom, neither $R_{43}$ nor $R_{47}$ is present;

and (8)

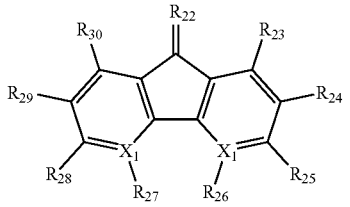

where, in the formula (8), $R_{22}$ represents an oxygen atom, a dicyanomethylene group, or an anilidene group, the anilidene group may have an alkyl group, $R_{23}$ to $R_{30}$ each independently represent a hydrogen atom, an ester group, or a nitro group, $X_1$ represents a carbon atom or a nitrogen atom, and, when $X_1$ represents a nitrogen atom, neither $R_{26}$ nor $R_{27}$ is present.

2. An electrophotographic photosensitive member according to claim 1, wherein the repeating structural unit represented by formula (11) has 2 to 4 carbon atoms.

3. A process cartridge, comprising:

the electrophotographic photosensitive member according to claim 1; and at least one device selected from the group consisting of charging device, developing device, transferring device, and cleaning device, wherein the process cartridge integrally supports the electrophotographic photosensitive member and the at least one device, and is attachable to and detachable from a main body of an electrophotographic apparatus.

4. An electrophotographic apparatus, comprising:

the electrophotographic photosensitive member according to claim 1;

charging device;

exposing device;

developing device; and transferring device.

5. An electrophotographic photosensitive member according to claim 1, wherein the electrophotographic photosensitive member comprises a conductive layer comprising a phenol resin between the conductive support and the intermediate layer.

* * * * *